United States Patent [19]

Morishita et al.

[11] Patent Number: 4,549,661

[45] Date of Patent: Oct. 29, 1985

[54] BANK NOTE PROCESSING DEVICE

[75] Inventors: Muneki Morishita, Takatsuki; Hiroyuki Nishimura, Kameoka; Hiroji Matsusaka, Uji, all of Japan

[73] Assignee: Omron Tateisi Electronics Co., Kyoto, Japan

[21] Appl. No.: 606,466

[22] Filed: May 3, 1984

[30] Foreign Application Priority Data

May 6, 1983 [JP] Japan ..... 58-79913

[51] Int. Cl.[4] ..... B07C 5/02

[52] U.S. Cl. ..... 209/534; 271/3; 271/186; 271/238; 271/305

[58] Field of Search ..... 271/3, 3.1, 238, 186, 271/305; 209/534

[56] References Cited

U.S. PATENT DOCUMENTS 4,465,193 8/1984 Kokubo ..... 271/3.1 X 4,479,049 10/1984 Hirose ..... 209/534 X

*Primary Examiner*—Richard A. Schacher

*Attorney, Agent, or Firm*—Stevens, Davis, Miller & Mosher

[57] ABSTRACT

A bank note processing device comprising a money access opening in the upper part of the bank note processing device for accepting incoming bank notes and releasing outgoing bank notes, a bank note stacking unit below the money access opening for stacking up the incoming bank notes supplied from the money access opening, and supplying the outgoing bank notes to the money access opening, a conveying attitude aligning unit, a bank note identifying unit therebelow, an unidentified bank note temporary storage unit, a face aligning unit, a conveying passage, to the rear of the conveying attitude aligning unit and the face aligning unit, and, along this conveying passage, an incoming bank note temporary pooling unit, a plurality of bank note storage units each of which takes in and stores the incoming bank notes of a corresponding denomination from the conveying passage, and a bank note recovery unit for taking in the bank notes to be recovered from the conveying passage, in that order from above to below.

4 Claims, 20 Drawing Figures

Completion of Taking Out

BANK NOTE PROCESSING DEVICE

BACKGROUND OF THE INVENTION

This invention relates to a bank note processing device such as an automatic money dispenser for use in the banking business for accepting incoming bank notes given by the customer, storing the accepted incoming bank notes into separate storage units for different denominations, and taking out and dispensing the outgoing bank notes from the bank note storage units in the amount requested by the user, and in particular to such a bank note processing device which has an internal arrangement suited for a rational flow of bank notes therein and easy maintenance for personnel who attends to the maintenance of the device.

In regards to an automatic money dispenser as described above, various complicated mechanisms are required for improving the service quality of the machine to the customer and saving the labor involved in various forms of work required on the part of the party who installed the machine.

Specifically, in such a bank note processing device, the required units are: a bank note stacking unit which stacks up the incoming bank notes given by the user in mixed denominations and the outgoing bank notes which have to be dispensed to the user in mixed denominations for each of the denominations, a conveying attitude aligning unit for aligning or correcting the skewing of the bank notes which are being conveyed, a bank note identifying unit which identifies the validity and the denomination of the bank notes, an unidentified bank note temporary storage unit for temporarily storing unidentified bank notes, a face aligning unit which aligns the faces of the incoming bank notes to one of the faces, an incoming bank note temporary pooling unit for temporarily pooling the incoming bank notes to cope with the need for processing the money returned due to cancellation of the transaction, bank note storage units for a plurality of denominations for storage of the incoming bank notes and sending out of the outgoing bank notes for each of the denominations, and a bank note recovery unit for recovering unsuccessfully dispensed bank notes which failed to be picked up by the user, and these mechanical units are so complicatedly involved that the increase in the size of the machine and the complications of the mechanical units and their control have been unavoidable. In particular, since the machine is intended for banking transactions, it is required to be reliable in its operation.

SUMMARY OF THE INVENTION

Accordingly, for coping with the above described problems, it is the primary object of the present invention to provide a bank note processing device which may be compactly structured as a whole through organic arragement and connection of the above mentioned mechanical units.

A second object of this invention is to provide a bank note processing device in which the working facility of the attendant in charging new bank notes, taking out stored bank notes and recovering those bank noted which should not be dispensed to the customers is improved.

A third object of this invention is to provide a bank note processing device in which the control of the internal flow of the bank notes is simplified on account of the fact that the control of the flow of the bank notes is one directional irrespective of whether the incoming bank notes or the outgoing bank notes are being processed.

According to the most general aspect of the present invention, these and other objects are accomplished by providing a bank note processing device, comprising a money access opening in the upper part of the bank note processing device for accepting incoming bank notes and releasing outgoing bank notes, a bank note stacking unit below the money access opening for stacking up the incoming bank notes supplied from the money access opening, sending them out from an internal lower part of a stack of bank notes, stacking up the outgoing bank notes which are sent from an internal upper part of the stack, and supplying the outgoing bank notes to the money access opening, a conveying attitude aligning unit, connected to to the bank note stacking unit by a bank note conveying means, for conveying the bank notes sent out from the lower part of the bank note stacking unit to a sending out position located thereabove, and aligning the conveying attitude of the bank note which is sorted in the sending in position and conveyed therefrom, a bank note identifying unit below this conveying attitude aligning unit for identifying the genuineness and the denomination of the bank note conveyed from the conveying attitude aligning unit, an unidentified bank note temporary storage unit in front of the bank note identifying unit and below the bank note stacking unit for sorting the bank note conveyed from the bank note identifying unit, temporarily storing this bank note, letting the bank note which does not require storage freely through this unit and conveying the bank note to be stored and freely passed bank note to a sending out side of the lower part of the bank note stacking unit, a face aligning unit below the unidentified bank note temporary storage unit and the bank note identifying unit for sorting the bank note conveyed from the bank note identifying unit so that all the bank notes face the same side up, a conveying passage, to the rear of the conveying attitude aligning unit and the face aligning unit, which can convey the bank notes from the face aligning unit to the conveying attitude aligning unit, and, along this conveying passage, an incoming bank note temporary pooling unit which takes in the incoming bank notes from this conveying passage for temporarily pooling and sending out the pooled bank notes to the conveying passage, a plurality of bank note storage units each of which takes in and stores the incoming bank notes of a corresponding denomination from the conveying passage and is associated with the denomination of the outgoing bank notes which are to be sent out to the conveying passage for dispensation, and a bank note recovery unit for taking in the bank notes to be recovered from the conveying passage, in that order from above to below.

According to such a structure, by providing the incoming bank note temporary pooling unit, the bank note storage units for various denominations, and the bank note recovery unit which are rectangular in shape in association with the shape of the bank notes in a vertically stacked up manner on one side of the rear portion, these may be built as blocks and therefore compact, by forming the money access opening to the front portion of the upper portion of these, a space is formed below the money access opening, and by arranging the bank note stacking unit and the conveying attitude aligning unit in this space, the bank note identifying unit therebelow, the unidentified bank note temporary storage unit to the front thereof, and the face aligning unit therebelow, any wasted space is eliminated, with the result that the space is advantageously filled up by the structural units, and the totality may be structured in a very compact manner.

Further, according to a more particular aspect of the present invention, these and other objects are more particularly and concretely accomplished by arranging the incoming bank note temporary pooling unit, the bank note storage units for different denominations, and the bank note recovery unit in a vertically stacked up manner on one side of the rear portion, when the attendant personnel is to set up the charged bank note and take out the bank note to be recovered, he can work on one side of the rear side and his workability is improved. In particular, by providing the bank note stacking unit, the bank note storage units and the bank note recovery unit on the side facing the customer, the access to the device for both the customer and the attendant personnel may be had from only one side.

Moreover, since the arrangement of the various mechanical units is aligned in the order of processing the incoming and the outgoing bank notes, irrespective of whether the bank notes are to be sent out or taken in, the conveying direction of the bank notes may be set up to one direction and the control of the conveying of bank notes becomes easy.

BRIEF DESCRIPTION OF THE DRAWINGS

The present invention will now be shown and described with reference to the preferred embodiments thereof, and with reference to the illustrative drawings. It should be clearly understood, however, that the description of the embodiments, and the drawings, are all of them given purely for the purposes of explanation and exemplification only, and are none of them intended to be limitative of the scope of the present invention in any way, since the scope of the present invention is to be defined solely by the legitimate and proper scope of the appended claims. In the drawings:

DESCRIPTION OF THE PREFERRED EMBODIMENTS

The drawings show an embodiment of the bank note processing device according to this invention, in the way of an automatic cash dispenser used in the banking business, which stores the incoming bank notes deposited by the user into each bank note storage unit for each different denomination and sends out and releases the outgoing bank notes of the denominations requested by the user from the bank note storage units.

Figure 1:
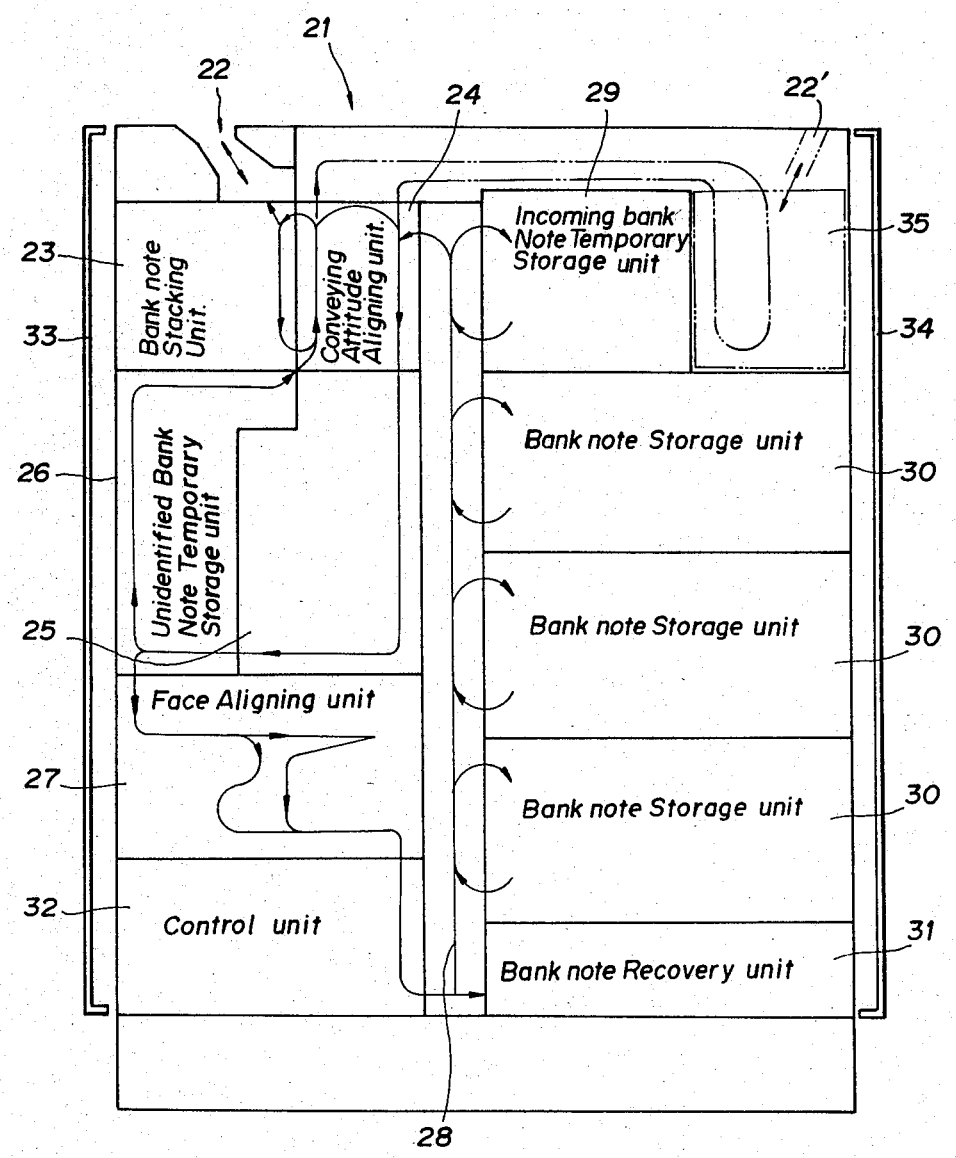
FIG. 1 is a schematic side view of the bank note processing device according to this invention showing the internal arrangement of the various units.

In FIG. 1 showing a side view of the bank note processing device with the customer's side located on the left in the drawing, the bank note processing device 21 has the following structural units. Specifically, with the side facing the customer when he performs the input operation assumed as being the front portion, provided are a money access opening 22 for accepting the incoming bank notes and releasing the outgoing bank notes in the upper part of the front portion, and a modularized bank note stacking unit 23, below the money access opening 22, which stacks up the incoming bank notes supplied from the money access opening 22, sequentially sends out these incoming bank notes from the lower part of the inside, bill by bill, stacks up the outgoing bank notes which have been sent from the upper part of the inside and, supplies these outgoing bank notes to the money access opening 22.

To the rear of the money stacking unit 23 is provided an also modularized conveying attitude aligning unit 24 which conveys the bank notes sent out from the lower part of the bank note stacking unit 23 to a sending in position located thereabove, and aligns the conveyed bank notes to a uniform attitude or in other words corrects the skewing of the bank notes sorted out and conveyed at this position so that the identification in the next unit may be assured.

Below the conveying attitude aligning unit 24 is provided a modularized bank note identifying unit 25 which identifies the validity, the denomination, and the acceptability of the aligned bank notes conveyed from the conveying attitude aligning unit 24.

To the front of the bank note identifying unit 25 and below the bank note stacking unit 23 is provided a modularized unidentified bank note temporary storage unit 26 which sorts out unidentified bank notes from the other bank notes to be freely passed which are conveyed from the bank note identifying unit 25, temporarily stores the unidentified bank notes, lets the bank notes which are not required to be stored freely pass this temporary storage unit 26, and conveys the stored bank notes and the freely passed bank notes so that they converge in the sending out side of the lower part of the bank note stacking unit 23.

Below the unidentified bank note temporary storage unit 26 and the bank note identifying unit 25 is provided a modularized face aligning unit 27 which sorts out the bank notes conveyed from the bank note identifying unit 25 so that the faces of the bank note are aligned to either one of them.

To the rear of the conveying attitude aligning unit 24, the bank note identifying unit 25, and the face aligning unit 27, is formed a vertical conveying passage 28 which can convey the bank notes from the face aligning unit 27 to the conveying attitude aligning unit 24.

Along this conveying passage 28 are arranged a modularized incoming bank note temporary pooling unit 29 which takes in and temporarily pools the incoming bank notes from the conveying passage 28 and sends out the pooled bank notes to the conveying passage 28, a plurality of modularized bank note storage units 30, which are provided to correspond to different denominations such as the ¥ 10,000 bill, the ¥ 5,000 bill, and the ¥ 1,000 bill, so as to take in and store the incoming bank notes of the corresponding denominations from the conveying passage 28 and to send out the outgoing bank notes to be dispensed out to the conveying passage 28, and a modularized bank note recovery unit 31 which takes in the bank notes to be recovered, for instance consisting of those bank notes which failed to be picked up and damaged bank note which may be accepted but should not be dispensed out, in a vertically stacked up manner.

Below the face aligning unit 27 is arranged a control unit 32 which drives and controls the various units 23 to 31 of the bank note processing device 21.

The bank note processing device 21 of this structure can be opened up at its front (left in FIG. 1) and rear (right in FIG. 1) faces by means of a front door 33 and a rear door 34 using an appropriate hinged structure, and charging of new bank notes into the bank note storage units 30, . . . and the recovery of bank notes from the bank note recovery unit 31 may be done by opening up the rear door 34. In other words, the device 21 is so adapted that the attendant may work on the rear side of the device 21.

When it is desired to have a type according to which the charging of bank notes into the bank note storage units 30, . . . and the recovery of bank notes from the bank note recovery unit 31 can be done from the customer side of the bank note processing device 21, it can be done by installing the bank note stacking unit 23 to the rear of the incoming bank note temporary pooling unit 29 and forming a money access opening 22' thereabove, as shown by an imaginary line in FIG. 1, so that the rear door 34 side may be used as the customer side. For that purpose, a space 35 is defined to the rear of the bank note temporary pooling unit 29 for installing the bank note stacking unit 23. And when the bank note stacking unit 23 is installed in the space 35, the bank note stacking unit 23 and the conveying attitude aligning unit 24 are connected together by providing an appropriate conveying means above the incoming bank note temporary pooling unit 29 as shown by an imaginary line of flow in FIG. 1.

Figure 2:
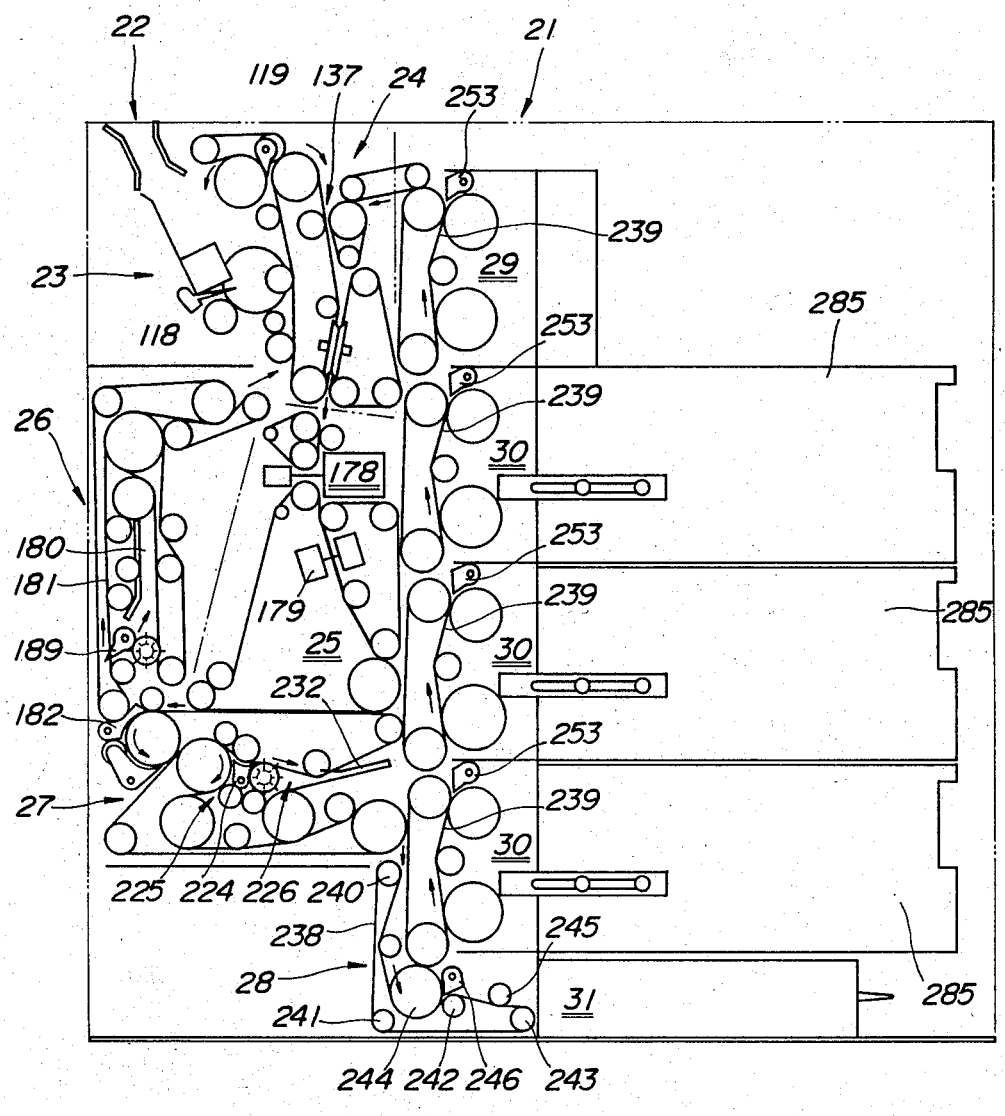
FIG. 2 is an internal side view of the device of FIG. 1.
Figure 3:
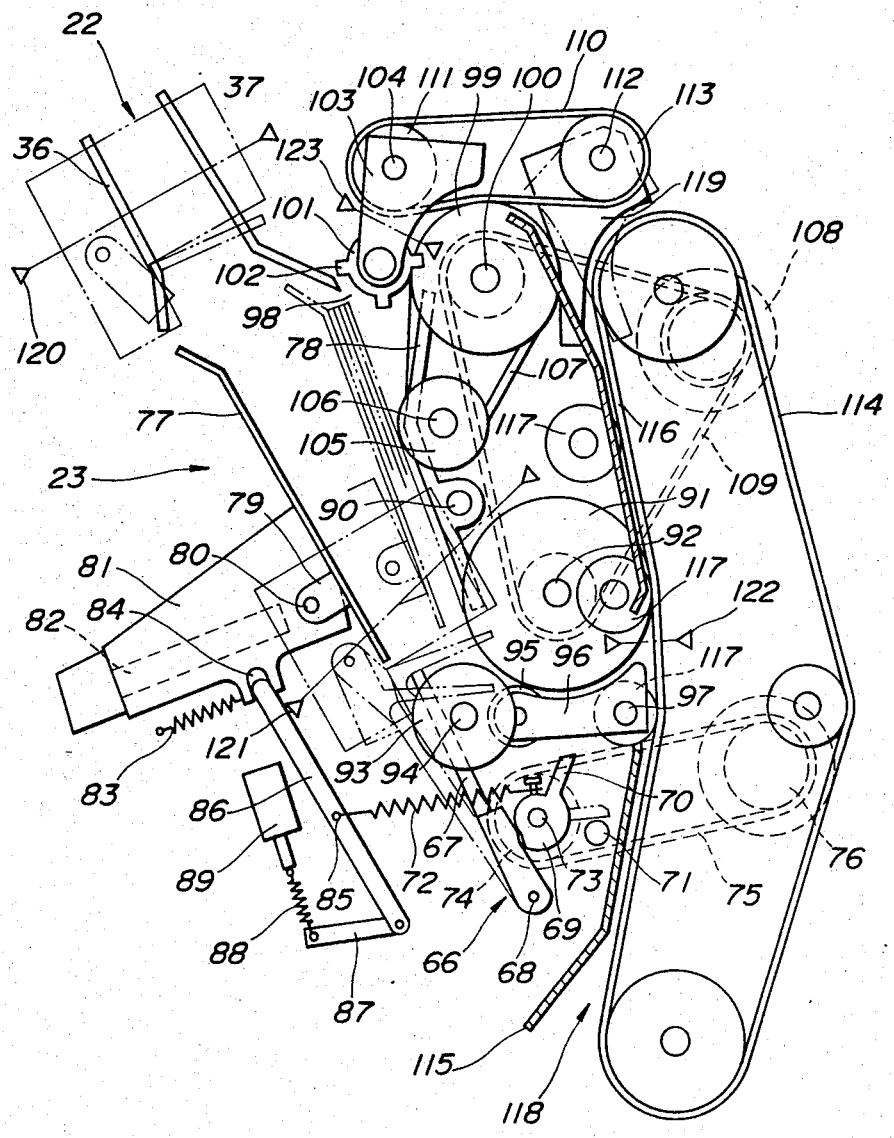
FIG. 3 is an internal side view of the bank note stacking unit.

With reference to FIGS. 2 and 3, the structure of the money access opening 22 and the bank note stacking unit 23 is described in the following.

The money access opening 22 is formed by guide plates 36 and 37 in the front and in the rear to a size which allows a large number of bank notes to be put thereinto in mixed denominations and in sideways.

Between the money access opening 22 and the bank note stacking unit 23 is provided a pair of clamps 38 which conveyingly supply the incoming bank notes to the bank note stacking unit 23 and the outgoing bank note to the money access opening 22.

Figure 4:
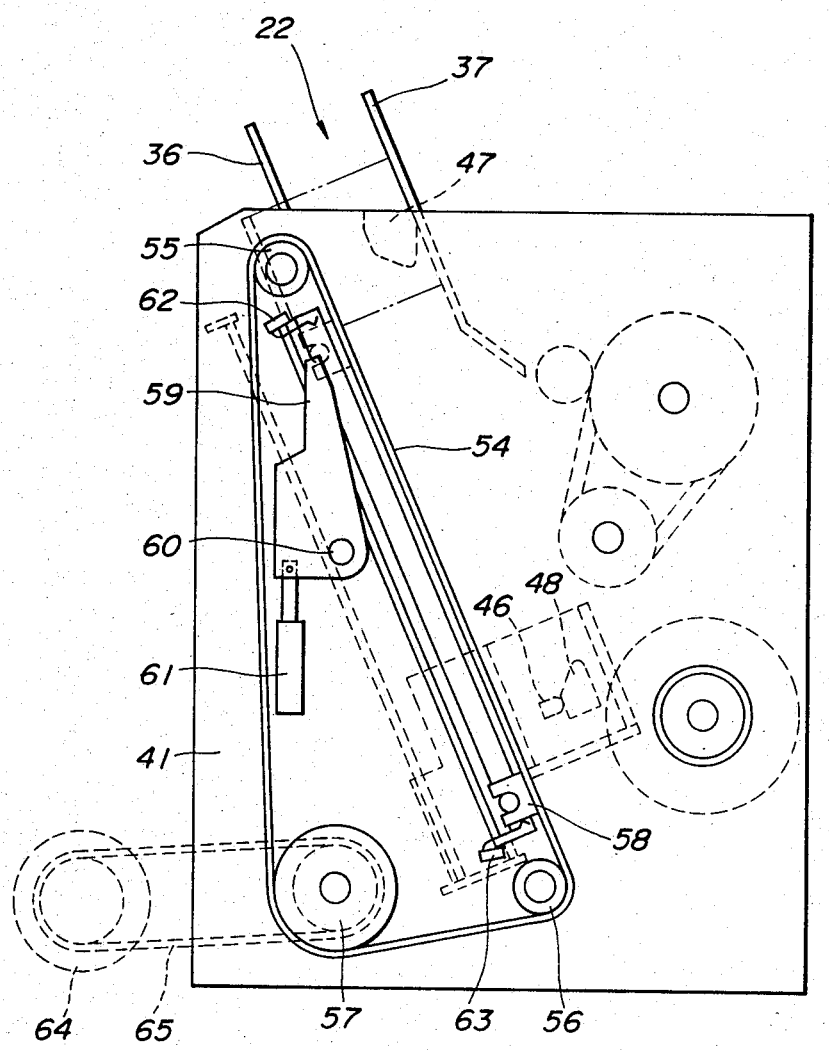
FIG. 4 is an external side view of the bank note stacking unit of FIG. 3.
Figure 5:
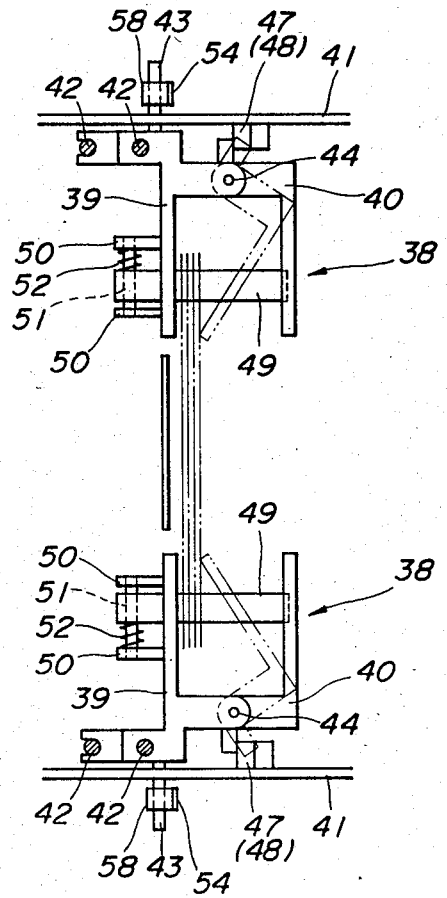
FIG. 5 is a plan view of the clamps.
Figure 6:
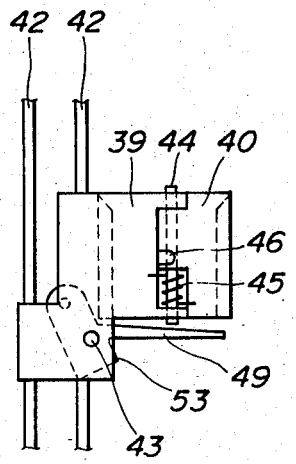
FIG. 6 is a side view of one of the clamps of FIG. 5.

As shown in FIGS. 4 to 6, each of the clamps 38 is comprised of two halves on the front and on the rear, each of which is formed by a fixed piece 39 and a movable piece 40. The fixed piece 39 is substantially L-shaped, and its base is vertically slidably supported by guide rods 42 and 42 which are bridged along the internal side of a side wall 41 and the external side end of this fixed piece 39 is provided with a connecting pin 43 which projects outwardly of the side wall 41 by passing through an appropriate slot provided in the sidewall 41.

The movable piece 40 is L-shaped, and one of its ends is pivoted to an end of the fixed piece 39 by way of a pin 44 so that the two pieces 39 and 40 form a rectangular shape with one open side. As shown in FIG. 6 also, a spring 45 is wound around the pin 44 so as to bias the movable piece 40 in the gripping direction. On the side wall 41 side of the movable piece 40 is provided an actuating piece 46 which may be actuated when releasing the grip of the movable piece 40.

In a position which is inside the side wall 41 and corresponds to the position of the actuating piece 46 when the clamps 38 are at their upper and lower movable limit positions are provided release cams 47 and 48, respectively, and by the actuating pieces 46 contacting these release cams 47 and 48 the gripping state of the movable pieces 40 is relieved. As a result, the clamps 38 are relieved from its gripping state at the positions of the money access opening 22 and the bank note stacking unit 23, and take on a bank note gripping state in the interval between these two position. To the lower surface of each of the clamps 38 on the right and on the left is provided a receiving plate 49 which receives with its upper surface the bank notes gripped by the clamp 38. This receiving plate 49 which is rotatably pivoted to supporting pieces 50 and 50 which are projectingly provided on the rear surface of the fixed piece 39 of each of the clamps 38 by means of a pin 51 can move from a closed position for closing the bottom of the clamp 38 to an open position for opening the bottom of the clamp 38 and the receiving plate 49 is normally biased by a spring 52 to the closing position. And it forms an actuating unit 53 for actuating a release actuating mechanism which will be described in detail later.

A pair of belts 54, on the right and on the left, which are adapted to vertically move the clamps 38, respectively, are wound around pulleys 55 to 57 which are rotatably supported in a cantilever manner on the side wall 41 to the outside of the side wall 41. An engagement piece 58 is fixedly secured to the inner side of each of the belts 54 which are associated with the motion of the clamps 38, and the connecting pin 43 of the clamp 38 is engaged to this engagement piece 58. Therefore, by forward and reverse motions of the belt 54, the clamp 38 may be moved both up and down.

A lock piece 59, which locks the downward motion of the connecting pin 43 of the clamp 38 when the clamps 38 are at their upper limit position adjacent to the money access opening 22, is pivoted to the side wall 41 by a pin 60 and this lock piece 59 is biased towards its locking position by way of an appropriate spring. To this lock piece 59 is connected a first solenoid 61 and when this first solenoid 61 is energized the locking of the lock piece 59 is released.

Further, a first limit switch 62 and a second limit switch 63 are provided in the upper and the lower limit positions, respectively, of the engagement piece 58 of the belt 54 for detecting the motion of the clamp 38 at its upper and lower limit positions, respectively. Power is transmitted from a first motor 64 which can rotate both in the forward and the reverse directions to a pulley 57 by way of a belt 65 and through the forward and the reverse motion control of this motor 64 the belt 54 may be driven to move the clamp 38 to both the upward and the downward directions, and the clamp 38 is stopped at its upper and lower limit positions as the motor 64 is controlled by first and second switches 62 and 63.

A release actuation mechanism 66 for the receiving plate 49 is provided so as to be opposite to the actuating unit 53 of the receiving plate 49 when the clamp 38 is at its lower position (FIG. 3).

The release actuation mechanism 66 has an actuation lever 67 opposite to the actuation unit 53, and this lever 67 is rotatively pivoted by way of a pin 68 and is biased towards an actuation cam 69 which will be described in detail later by means of an appropriate spring which is not shown in the drawing.

An actuation cam 69 is located on the side surface of the base of the actuation lever 67 and by clockwise rotation of this actuation cam 69 in the sense of FIG. 3 the actuation lever 67 is moved counterclockwise in such a manner that the motion of the actuation lever 67 causes the tip of the actuation lever 67 to push down the actuation unit 53 so as to rotate the receiving plate 49 to a release position.

A stopper piece 70 is integrally provided in a part of the cam surface of the actuation cam 69 and by the contact of the stopper piece 70 onto a stopper pin 71 the rotation of the actuation cam 69 is prohibited, while the restoring motion of the actuation cam 69 is effected by the action of a spring 72 which is engaged to both a pin fixedly secured to the cam surface of the cam 69 and a pin 85 fixedly secured to an intermediate portion of a lever 85 which will be described later.

The actuation cam 69 is supported on a shaft 73 by way of an appropriate torque limiter (which is not shown in the drawing) and by being engaged to this shaft 73 the power trasmitted from a second motor 76 may be trasmitted to the actuation cam 69 by way a belt 75 and a pulley 74 which is fixedly secured to the shaft 73.

The actuation cam 69 is normally at a position corresponding to the closed position of the receiving plate 49, and by the rotation of the second motor 76 in a certain direction rotates to a position adapted for moving the receiving plate 49 to the releasing position by way of the actuating lever 67, and when the stopper piece 70 contacts the stopper pin 71 the rotative power transmitted to the actuation cam 69 is disconnected by means of the torque limiter. While the rotation of the second motor 76 is maintained, the stationary state of the receiving plate 49 at its release position is continued. When the second motor 76 is stopped, the actuating cam 69 restores to its original position under the action of the spring 72 thereby causing the receiving plate 49 to return to its closed position at the same time.

The bank note stacking unit 23 forms a box shape with a pressure plate 77, a guide plate 78 opposing thereto, the clamps 38, and the receiving plates 49 associated to the clamps 38.

The pressure plate 77 has a width which allows it to be located between the clamps 38 and 38 and a mounting piece 79 is provided on its rear surface. This mounting piece 79 is pivoted to a support member 81 by way of a pin 80 so as to be swingable along the vertical direction and a support member 81 is in turn supported by an appropriately fixed support rod 82 so as to be slidable in the fore and aft directions and is biased by a spring 83 towards the rear. An actuation slot 84 is formed on the lower part of the support member 81, and an upper end of a lever 86 whose middle portion is pivoted by a pin 85 is connected to the actuation slot 84. A second solenoid 89 is connected to the lower end of the lever 86 by way of a connecting rod 87 and a spring 88. And by turning on this solenoid 89, the lever 86 is moved in such a manner that the support member 81 is pushed forward as indicated by an arrow and pushes the pressure plate 77 towards the opposing guide plate 78 by means of the biasing force of a spring 88.

The guide plate 78 has a width which allows it to be fitted between the two clamps 38 and 38 and is bent in the middle so that its upper portion faces the rear side and, by being pivoted to a shaft 90 at its lower part on the rear side, is accommodated to evenly receive the pressure with which the pressure plate 77 pushes the bank notes.

A take in roller 91 is supported on a rotary shaft 92 at each of the right and the left positions opposing to the side ends of the pressure plate 77 inside of the lower part of the bank note stacking unit 23, and by the rotation of this roller 91 in the taking in direction the bank note in the bank note stacking unit 23 is taken in to the later stage side.

Opposite to the take in roller 91 is provided a gate roller 93 at a position below the bottom of the bank note stacking unit 23, and this gate roller 93 is supported on a shaft 94 by way of an appropriate one way clutch so that it is constrained in the take in direction and is freely rotatable in the non take in direction, and by being in a stationary state when the take in roller 91 is rotating in the take in direction prevents double take in (or, in other words, taking in more than one bill of of bank note at the same time) by giving some friction to the bank note which is being taken in.

Opposite to the take in roller 91 to the side of the take in direction is provided a gripping roller 95 and this gripping roller 95 is rotatively supported to an end of a take in guide plate 96, and to the other end of the guide plate 96 is pivoted a shaft 97 which carries guide roller 117 which will be described later. And the guide plate 96 is so biased by an appropriate spring that the gripping roller 95 is biased towards the take in roller 91.

Thus, the bank note which is being taken in by the take in roller 91 is prevented from being doubly taken in by the gate roller 93, and, by receiving a conveying force from the gripping roller 95, is taken in guided by the take in guide plate 96.

Between the upper end of the guide plate 78 of the bank note stacking unit 23 and the lower end of the guide plate 37 of the money access opening 22 is formed a send out opening 98 for sending outgoing bank notes into the bank note stacking unit 23, and a send in roller 99 is supported on a rotary shaft 100 at each of the right and the left positions corresponding to the side ends of the guide plate 78, and further a curling roller 101 is provided opposite to this send in roller 99.

By driving the send in roller 99 to the sending in direction, the bank note to be sent into the bank note stacking unit 23 is sent into the bank note stacking unit 23 through a nip formed between the curling roller 101 and the send in roller 99. The curling roller 101 has a plurality of curling projections 102 . . . on its external ends of the circumference opposite to the send in roller 99 so that by the contact of these projections 102 with the bank note on the external ends of the send in rollers 99 on the right and on the left the two side ends of the bank note are curved so as to give the bank note some rigidity and to prevent the bank note from being folded up when it is being sent out.

At the same time, the curling projections 102 facilitate the stacking up of the newly sent in bank notes by contacting the upper end of the already stacked up bank notes and striking them towards the pressure plate 77.

The curling roller 101 is rotatively supported on one end of the send in guide plate 103 and the other end of this guide plate 103 rotatively carries a shaft 104 and is so biased by an appropriate spring as to bias the curling roller 101 towards the send in roller 99.

On each of the right and the left positions of the sides of the guide plate 78 in an intermediate position between the take in roller 91 and the send in roller 99 is rotatively supported an auxiliary roller 105 on a shaft 106 and these auxiliary rollers 105 receives power from the send in roller 99 by way of a belt 107 so as to assist the taking in and sending in actions of the bank note.

And the take in roller 91 and the send in roller 99 receive power from a third motor 108 by way of a belt 109 which is passed around both the pulleys securely attached to the take in roller 91 and the send in roller 99.

Opposite to the upper side of the send in roller 99 is provided an auxiliary belt 110 which is stretched between a pulley 111 which is mounted on the shaft 104 rotatively supported on the send in guide plate 103 and a pulley 113 which is supported on a shaft 112, for assisting the conveyance of the bank note being conveyed to the side of the send in roller 99.

A conveying belt 114 of the conveying attitude aligning unit 24 is provided in the rear of the take in roller 91 and the send in roller 99 opposite thereto, and by providing guide plates 115 and 116 and the guide rollers 117 rotatively supported on the other end of the guide plate 96, opposite to a run of the conveying belt 114, a conveying passage 118 is defined.

And the bank note sent out from the take in roller 91 is at first conveyed upwards by the upper part of the conveying belt 114. And the lower part of the conveying belt 114 accepts the bank note conveyed from the unidentified bank note temporary storage unit 26 and conveys it also upwards.

Adjacent to the upper end of the conveying belt 114, a first sorting plate 119 is pivoted on a shaft 112 for sorting the conveyed bank note either to the side of the bank note stacking unit 23 or to the side of the conveying attitude aligning unit 24, and is adapted to sort it to the side of the aligning unit 24 under normal circumstances and to sort it to the bank note stacking unit 23 (as shown by an imaginary line) by being driven by an appropriate solenoid which is not shown in the drawing.

A first sensor 120 provided in the money access opening 22 detects the acceptance and the removal of bank notes and a second sensor 121 provided below the bank note stacking unit 23 detects that the bank notes have been removed while a third sensor 122 provided to the send out side of the take in roller 91 detects the sending out of the bank notes and a fourth sensor 123 provided on the side of the send in roller 99 detects the sending in of the bank notes, and these sensors 120 to 123 consist of per se known photoelectric sensors.

Figure 7:
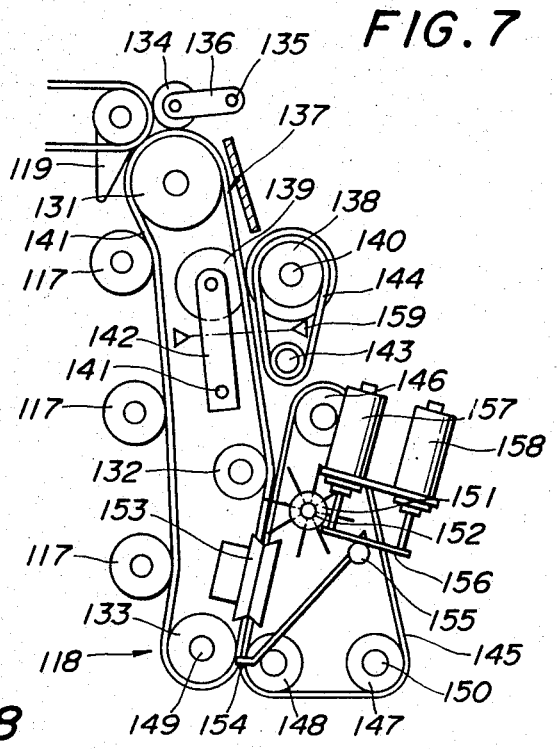
FIG. 7 is an side view of the conveying attitude aligning unit.
Figure 8:
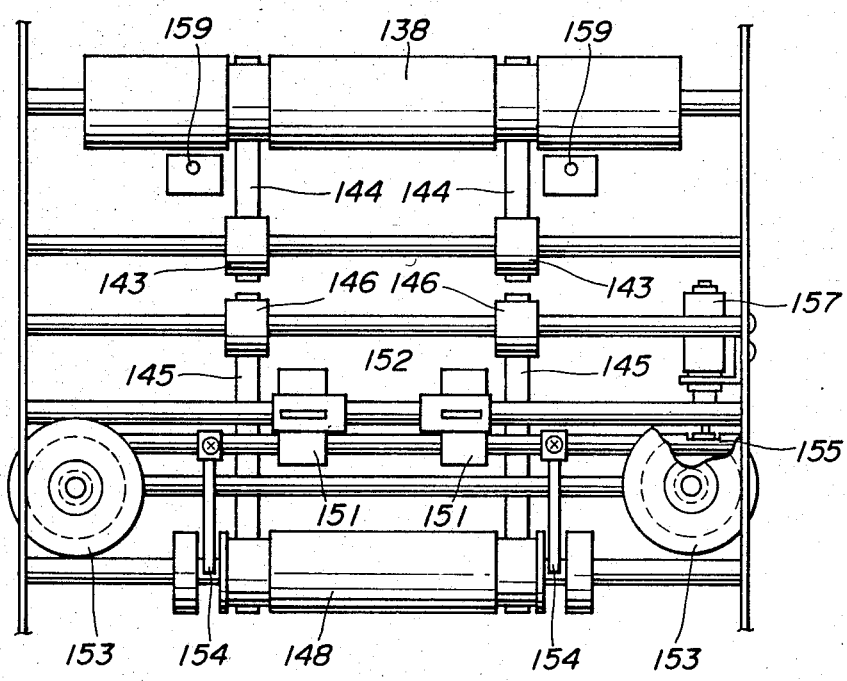
FIG. 8 is a front view the conveying attitude aligning unit of FIG. 7.

With reference to FIGS. 2, 7, and 8, the structure of the conveying attitude aligning unit 24 will be described in the following.

This conveying attitude aligning unit 24 performs a skew aligning process which, when the conveying attitude of the bank note is inclined or in other words is skewed relative to the conveying direction, aligns the bank note so that its forward end aligns perpendicular to the conveying direction, and a width aligning which, since the conveying width of the conveying passage is made broad enough so that bank notes of different denominations having different configurations may be conveyed, moves the bank note to within an allowable range in the middle part of the conveying passage.

The conveying belt 114 is stretched across pulleys 131 to 133, of which the upper end pulley 131 is made broader than the others so that a wrinkle correction roller 134 may be provided opposite to its middle portion for straightening the wrinkles of the bank note passing through this portion. The base end of this roller 134 is supported on the free end of an arm 136 which is pivoted by way of a pin 135 and is biased towards the pulley 131 by way of a spring (which is not shown in the drawing).

Additionally, a pair of wrinkle correction rollers 138 and 139 are opposingly provided, with an upper part of the conveying passage 137 interposed therebetween on the aligning side of the conveying belt 114, and these rollers 138 and 139 are made broader like the mentioned wrinkle correction roller 134. By driving a shaft 140 of the one of the rollers 138 in the conveying direction, the wrinkles of the bank note passing through this portion are straightened. The other roller 139 is supported on the free end of an arm 142 whose base end is pivoted by a pin 141 and is biased toward the other wrikle correction roller 138 by way of an appropriate spring (which is not shown in the drawing).

Across a pulley securely attached to the wrinkle correction roller 138 and a pulley 143 provided therebelow is stretched an auxiliary belt 144, opposite to the conveying belt 114, and this auxiliary belt 144 and the conveying belt 114 oppose each other with a gap therebetween so as to give slight conveying force to the bank note passing therethrough.

Opposite to the conveying belt 114 below the auxiliary belt 144 is provided an auxiliary belt 145. This auxiliary belt 145 is stretched across pulleys 146, 147, and 148 in a triangular shape, and the run of the auxiliary belt 145 between the pulleys 148 and 146 gives conveying force to the bank note by contacting itself to the conveying belt 114 so as to send out the bank note to the bank note identifying unit 25 downwards. In particular, the gap between the auxiliary belt 145 and the conveying belt 114 is gradually increased towards the conveying entry end or towards the pulley 146 and the conveying force along the conveying passage is thereby weakened towards the conveying entry end so that the aligning of the bank note may be facilitated. The portion of the conveying passage adjacent to both this auxiliary belt 145 and the auxiliary belt 144 located thereabove is provided with a space for freeing the rear end of the bank note when it is being aligned.

And by driving a shaft 149 of the pulley 133 and a shaft 150 of the pulley 147, the bank note is conveyed for aligning.

A vane wheel 151 is fixedly secured to each of the right and the left ends of a shaft 152 which extends at the conveying entry end of the auxiliary belt 145 and this vane wheel 151 is provided with vanes each consisting of soft rubber material, and, as the shaft 152 turns in the conveying direction, gives vibrations to the bank notes for promoting the aligning action.

In a stage following the vane wheels 151, a sideways motion roller 153 is rotatively supported on a shaft which is perpendicular to both the conveying direction and the width of the conveying belts 114 and 145 at each of the right and the left ends along the width of the conveying passage 137, and the circumferential surface of this roller 153 is grooved in a triangular shape in its middle, and by being rotated in the conveying direction by an appropriate driving system not shown in the drawing, guides the left or the right side end of the bank note between the grooved circumferential surfaces for sideways guided motion of the bank note towards the center of the conveying passage 137.

The space between the right and the left sideways motion rollers 153 defines a range in which the bank note identifying unit 25 of the next stage can identify the bank note.

On either side of the nip defined between the pulleys 133 and 148 is provided an aligning stopper 154 in such a manner that it can freely come into and go out from the conveying passage 137. This aligning stopper 154 is fixedly secured to an actuation shaft 155, and to this actuation shaft 155 is fixedly connected a middle portion of an actuation lever 156. The two ends of this actuation lever 156 are connected to a third solenoid 157 for drive and a fourth solenoid 158 for release, respectively, and the third solenoid 157 for drive is actuated in such a manner that the aligning stopper 154 may be brought into the conveying passage 137 while the fourth solenoid 158 for release may be actuated in such a manner that the aligning stopper 154 is actively taken out from the conveying passage 137, so as to achieve a fast overall response by selective activation of either one of the solenoides 157 and 158.

A fifth sensor 159 consisting of a photoelectric switch for detecting the arrival of a bank note is provided in association with the auxiliary belt 144.

In this conveying attitude aligning unit 24, when the fifth sensor 159 detects the arrival of a bank note, the third solenoid 157 for drive is driven and projects the aligning stopper 154 into the conveying passage 137, thereby achieving a bank note aligning state and, after the conveying time in which the detected bank note reaches the aligning stopper 154 and the time required for aligning the skewed bank note by contacting it to their aligning stoppers 154 on the right and on the left are counted at the same time, the fourth solenoid 158 for release is driven at the same time as the third solenoid 157 is turned off for moving the aligning stopper 154 away from the conveying passage 137.

As a result, the bank note is aligned sideways by the sideways motion roller 153, and after being temporarily stopped by the aligning stopper 154 for skew aligning is sent out to the next stage.

Figure 9:
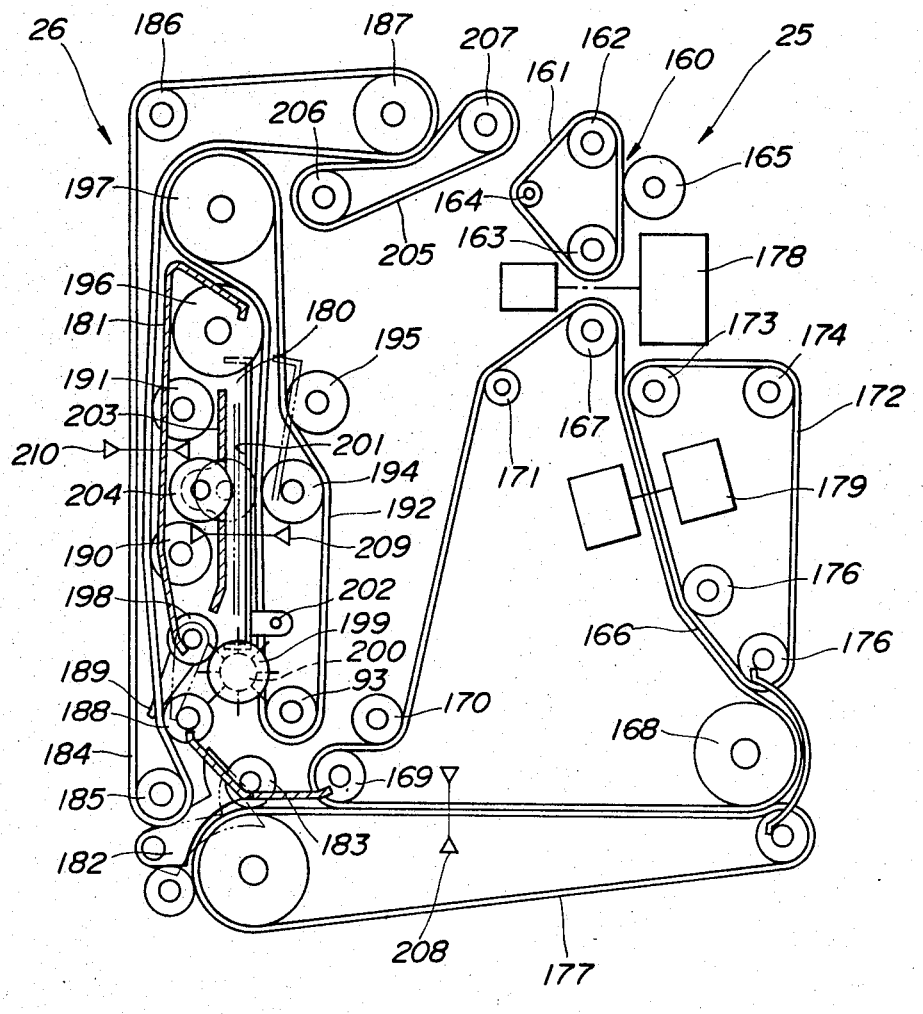
FIG. 9 is a side view of the bank note identifying unit and the unidentified bank note temporary storage unit.

With reference to FIGS. 2 and 9, the structure of the bank note identifying unit 25 will be described in the following.

Following the bank note sending out side of the conveying attitude aligning unit 24, a conveying belt 161 is located on one side of its conveying passage 160, across pulleys 162, 163, and 164, and a guide roller 165 is placed across the conveying surface of the conveying belt 161.

In a stage following the conveying belt 161 with a certain distance thereto, a conveying belt 166 is stretched across pulleys 167 to 171 and an auxiliary belt 172 is opposingly placed upon the upper part of the conveying belt 166. This auxiliary belt 172 is stretched across the pulleys 173 to 176 and a conveying belt 177 of the face aligning unit 27 is opposingly placed upon a lower position of this conveying belt 166. The conveying belts 161 and 166 are driven in the conveying direction by an appropriate drive source.

An image sensor 178 is provided in a gap between the two conveying belts 161 and 166 and a photoelectric sensor 179 is placed across the nip between the conveying belt 166 and the auxiliary belt 172. By means of the image sensor 178 and the photoelectric sensor 179, the printed pattern of the bank note passing through these parts is read out and the identification of the bank note such as its validity, acceptability, denomination, and the determination of which face is up is performed.

With reference to FIGS. 2 and 9, the structure of the unidentified bank note temporary storage unit 26 will be described in the following.

The unidentified bank note temporary storage unit 26 forms a conveying passage for storage 180 for temporarily storing the unidentified bank note which could not be identified or has been determined to be invalid in the bank note identifying unit 25, and a conveying passage for free passage 181 for letting the bank note which is not required to be stored such as outgoing bank notes to pass freely therethrough.

On the rear end, along the conveying direction, of a conveying belt 177 opposing the conveying belt 166 of the bank note identifying unit 25 is provided a second sorting plate 182 which is driven for sorting action by an appropriate solenoid (which is not shown in the drawing). This second sorting plate 182 sorts out the bank note conveyed from the previous stage into the unidentified bank note temporary storage unit 26 and the face aligning unit 27, and is normally in the position to sort the bank note into the temporary storage unit 26 and may be driven therefrom to another position for sorting the bank note into the face aligning unit 27.

A guide roller 183 is provided opposite to a conveying end portion of the conveying belt 77 and in the following stage a conveying belt 184 extends vertically across pulleys 185 to 187. A guide roller 188 is provided opposite to a conveying entry end of the conveying belt 184, and takes in the bank note conveyed from the previous stage to the temporary storage unit 26 in cooperation with the guide roller 183.

In a stage following the guide roller 188 is located a third sorting plate 189 which is normally positioned to the side of the conveying passage for storage 180 and may be driven by an appropriate solenoid (which is not shown in the drawing) into sorting the bank note to the side of a conveying passage for free passage 181.

The above mentioned conveying passage for free passage 181 is formed by providing guide rollers 190 and 191 opposite to the conveying belt 184.

In the conveying passage for storage 180, a conveying belt 192 extends along the vertical direction across pulleys 193 to 197 and a pair of send in rollers 198 and 199 are provided at the conveying entry end of the conveying passage 180. One of the send in rollers 199 is attached with a vane wheel 200 which has vanes made of soft rubber material, and by being turned in the send in direction pushes the lower end of the sent in bank note to the side of the belt 192 so as to facilitate the sending in action for the bank note to be stored next.

On the front side of the conveying belt 192 in the conveying passage for storage 180 is located a receiving frame 201 of a rectangular shape with one open side, and this receiving frame 201 is offset from the conveying belt 192 so that its upper end can move from the front side position to the rear side position of the conveying belt 192 with a pin 202 provided in a lower part acting as a pivot by means of an appropriate solenoid (which is not shown in the drawing).

In front of the receiving frame 201 is provided a pressure plate 203 with a certain space therebetween for storing a certain number of bank notes therein, and this pressure plate 203 is integrally formed with the receiving frame 201 for integral motion therewith. Further, a pressure roller 204 is rotatively supported on the pressure plate 203 opposite to a conveying belt 192 so that by receding motion of the receiving frame 201 the stored bank note is pressed to the side of the conveying belt 192 by the pressure plate 203 and the pressure roller 204 and the stored bank note is conveyed to be sent out to the conveying passage for free passage 181 from the conveying passage for storage 180 under a conveying force.

Opposite to the conveying exit end of the conveying belt 184 is opposingly extended an auxiliary belt 205 across pulleys 206 and 207 in such a manner that the bank note to be passed and the bank note to be stored conveyed by the conveying belts 180, 184 are both sent out to the sending out side of the lower part of the bank note stacking unit 23 or, in other words, to the lower end of the conveying belt 114.

A sixth sensor 208 provided on the rear end side of the conveying passage 160 of the bank note identifying unit 25 detects the number of bank notes which have been identified, a seventh sensor 209 provided in the conveying passage for storage 180 of the unidentified bank note temporary storage unit 26 detects the sending out of the bank note to be stored and the stored bank note, and an eighth sensor 210 provided in the conveying passage for free passage 181 detects the passage of bank note therethrough. These sensors are comprised of per se known photoelectric sensors.

Figure 10:
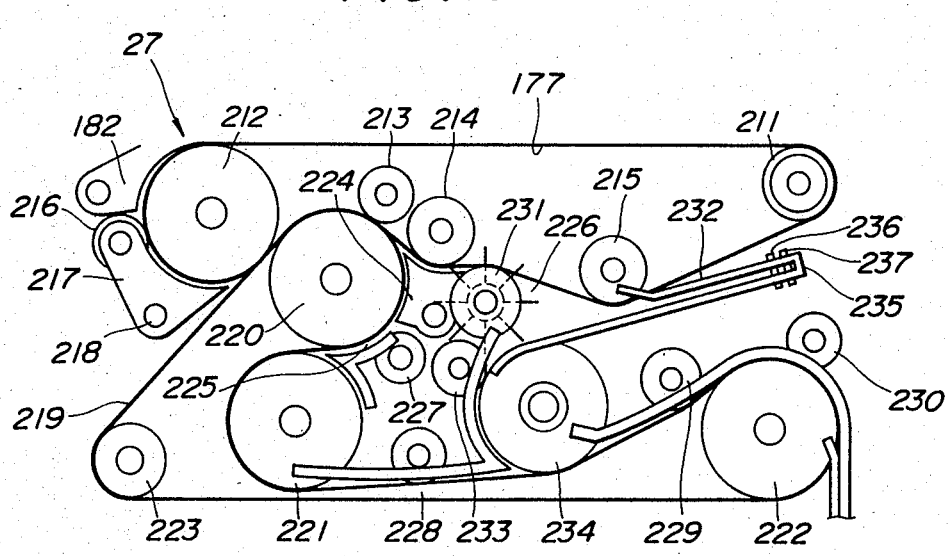
FIG. 10 is a side view of the face aligning unit.

With reference to FIGS. 2 and 10, the structure of the face aligning unit 27 will be described in the following.

The bank note face aligning unit 27 unifies the facing of the bank notes to one of the faces according to the face determination made by the bank note identifying unit 25 of the previous stage.

The conveying belt 177 is stretched across pulleys 211 to 215, and a guide roller 216 opposes a conveying entry end of this conveying belt 177. This guide roller 216 is rotatively supported on one end of a guide plate 217 and a middle portion of the guide plate 217 is pivoted by a pin 218 in such a manner that the guide roller 216 may be biased towards the conveying belt 177 by way of an appropriate spring. And the guide plate 217 also serves as a guide for conveying bank notes.

In a stage following the guide plate 217 is located a conveying belt 219 whose portion contacts the conveying belt 177. This conveying belt 219 is stretched across pulleys 220 to 223.

In the position at which the two conveying belts 177 and 219 leave apart from each other is provided a fourth sorting plate 224 which is driven for sorting action by an appropriate solenoid (which is not shown in the drawing). This sorting plate 224, which sorts the bank note conveyed from the bank note identifying unit 25 of the previous stage by way of the second sorting plate 182 into a conveying passage and 225 for free passage a conveying passage for inversion 226, is normally in a position for guiding the bank note to the side of the conveyor for free passage 225 and may be switched to a position for guiding the bank note to the side of the conveying passage for inversion 226.

The conveying passage for free passage 225 is formed by the contacts between the conveying belt 219 and the guide rollers 227 to 230. On the entry end the conveying passage for inversion 226 is provided a vane wheel 231, and an inversion frame 232 with a bottom is provided in a stage following this vane wheel 231. A pair of sending in rollers 233 and 234 are opposingly provided below the vane wheel 231.

The vane wheel 231 has vanes made of soft rubber material, and is adapted to send out the conveyed bank note to the side of the inversion frame 232 and strike in the rear end of the bank note downwardly at the same time as supplying it to between the send in rollers 233 and 234.

The inversion frame 232 is so dimensioned that the length or distance between its bottom plate 235 to the vane wheel 231 corresponds to the greatest length of the bank notes of all the denominations to be handled, and, to cope with other shorter bank notes, stoppers 236 and 237 are provided adjacent to the bottom plate 235 of the inversion frame 232 in such a manner that by driving these stoppers 236 and 237 with an appropriate solenoid (which is not shown in the drawing) the stoppers can project out into the inversion frame 232 so as to position the front end of the bank note, and the selection of the stoppers 236 and 237 is made according to the determination of the denomination by the bank note identifying unit 25 of the previous stage.

When the conveying belts 177 and 219 are driven in the conveying direction and the face of the bank not conveyed to the face aligning unit 27 is required to be inverted, according to the determination of the face by the bank note identifying unit 25, the fourth sorting plate 224 is driven in such a manner that the bank note is sent into the inversion frame 232 by way of the conveying passage for inversion 226 and by being struck at its rear end by the vane wheel 23 the rear end of the bank note is supplied to the send in rollers 233 and 234 which in turn, by sending this bank note into the conveying passage for free passage 225, inverts the face of the bank note.

With reference to FIG. 2, the structure of the conveying passage 28 will be described in the following.

The conveying passage 28 is provided in such a manner that the bank note sent out from the face aligning unit 27 may be conveyed to the conveying attitude aligning unit 24 located thereabove.

The above described conveying passage 28 is comprised of conveying belts 238 and 239, . . . , and the conveying belt 238 is stretched across pulleys 240 to 243 and forms an L-shaped conveying passage with a guide roller 244 opposingly positioned adjacent to its middle portion. The conveying exit end extends to a position in front of the bank note recovery unit 31, and a guide roller 245 is provided opposite to this extension.

Opposite to the guide roller 244 which forms part of the L-shaped conveying passage is provided a fifth sorting plate 246 which is normally in a sorting position for conveying the bank note upwardly and may be driven by an appropriate solenoid so as to sort the bank note into the bank note recovery unit 31 according to the determination of unacceptable bank note at the bank note identifying unit 25 and the failure of the bank note to be picked up after it is released to the money access opening 22.

A conveying passage is formed by positioning guide rollers 247, . . . opposite to the conveying belts 239, . . . which are disposed in series along the vertical direction, and each of the conveying belts 239 is associated with each of the bank note storage units 30 and the incoming bank note temporary pooling unit 29 for each denomination of the bank notes, and is driven by an appropriate drive means.

The upper end of the conveying passage 28 is connected to a conveying entry end of the conveying passage 137 of the conveying attitude aligning unit 24 by way of an appropriate guide means.

Figure 11:
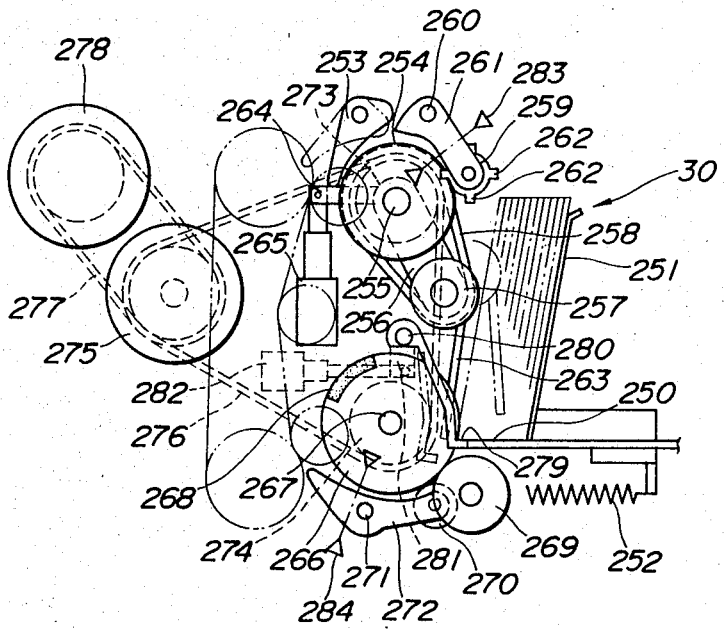
FIG. 11 is a side view of one of the bank note storage units.

With reference to FIG. 11, the structure of the bank note storage units will be described in the following.

Since the bank note storage unit 30 of each different denomination is identical to the others, except for the fact that the denomination of the bank notes to be stored is different, only one of them will be described in the following. The bank note storage unit 30 has a placement plate 250 for storing bank notes with its their sides along the vertical direction and overlaid along a horizontal direction, each bank note standing upright, and a pressure plate 251 is placed to the rear of this placement plate 250 in such a manner that it can move in the fore and aft directions (the coming out and the receiving directions) and is biased towards the front by a spring 252. A sixth sorting plate 253 is provided above the front portion of the bank note storage unit 30, and this sorting plate 253 is provided for taking in the bank note being conveyed by the conveying passage 28 into this bank note storage unit 30. The sorting plate 253 is normally located outside of the conveying passage 28, and, when the bank note is determined to be a one to be stored in this bank note storage unit 30, is driven by an appropriate solenoid in such a manner that its tip projects into the conveying passage 28 and takes in the bank note to the side of the storage unit 30.

Above the front portion of the bank note storage unit 30, a send in roller 254 is fixedly positioned on a rotary shaft 255, and this send in roller 254 operates within a range of a certain width in the lengthwise middle portion of the bank note.

An end of a frame 256 is rotatively pivoted to the rotary shaft 255, and the other end of the frame 256 extends to a middle position of the front portion of the bank note storage unit 30. An auxiliary roller 257 is supported on an extreme free end of the rotary shaft 255 and a belt 258 is stretched across the auxiliary roller 257 and a send in roller 254 for the transmission of power.

A curling roller 259 is provided opposite to the send in roller 254 and this roller 259 is supported on a free end of a guide plate 261 which is pivoted to a support shaft 260 at its one end in such a manner that the curling roller 259 may be rotated by contacting the send in roller 254.

The curling roller 259 is provided with a plurality of curling projections 262 . . . on its outside over widths of the conveying width of the send in roller 254, and these curling projections 262 . . . serve to curve the side ends of the bank note by contacting the bank note outside of the conveying width of the send in roller 254 so as to give some rigidity to the bank note and to prevent the bank note from being bent when sending in (storing) the bank note. At the same time, the projections 262 . . . form a gap for sending in bank notes to the inside of the storage unit 30 by striking the upper end of the bank notes already stored in the bank note storage unit 30 and are located in the front.

A pushing plate 263 is provided in association with the free end of the frame 256, and the lower end of the pushing plate 263 extends to the adjacent part of the placement plate 250. An actuation piece 264 is provided in association with the base portion of the frame 256 and a fifth solenoid 265 is connected to this actuation piece 264.

When the fifth solenoid 265 is energized, it moves the pushing plate 263 along with an auxiliary roller 257, and when this solenoid 265 is deenergized the pushing plate 263 and the auxiliary roller 257 are located in the positions which allow them the storage and the sending out of the bank notes. Meanwhile, when the solenoid 265 is turned on, the pushing plate 263 is moved to a position which allows it to push the bank note into the bank note storage unit 30 in cooperation with the auxiliary roller 257. Below the front portion of the bank note storage unit 30, a take out roller 266 is fixedly secured to a rotary shaft 267 opposite to the front end of the placement plate 250.

The take out roller 266 acts over a region having a width of the central portion of the bank note. A take out surface 268 made from a material of a high frictional resistance is formed in part of the circumferential surface of the roller 266, and other parts of the circumferential surface of the roller 266 are formed of a material of low frictional resistance so that the take out surface 268 may take out the stored bank note by contacting therewith but when the other part of the roller contacts the bank note the roller slips and no bank note is taken out.

Opposite to the take out roller 266 is provided a gate roller 269 for controlling the double release of the bank note on the lower surface side of the placement plate 250, and this gate roller 269 which is incorporated with an appropriate one way clutch is rotatable in the anti take out direction but is not rotatable in the take out direction. In a stage next to the gate roller 269 a grip roller 270 is provided opposite to the take out roller 266 and one end of the grip roller 270 is rotatably supported on an end of a guide plate 272 whose other end is pivoted to a support shaft 271.

The bank note taken out from between the rear end portion of the guide plate 272 and the take out roller 266 is sent into a conveying belt 239 of the conveying passage 28.

Pulleys 273 and 274 are fixedly secured to the rotary shaft 255 of the send in roller 254 and the rotary shaft 267 of the take out roller 266, and power is transmitted from an electromagnetic clutch 275 to these pulleys 273 and 274 by way of a belt 276. And power is transmitted from a motor 278 to the electromagnetic clutch 275 by way of a belt 277.

The electromagnetic clutch 275 is additionally provided with an electromagnetic brake (which is not shown in the drawing).

To the front end of the placement plate 250 of the bank note storage unit 30 is opposed a gate plate 279 whose tip is bent into an L-shape. The base end of this gate plate 279 is pivoted to a support shaft 280 and an actuation piece 281 is provided in association with the base end, and a sixth solenoid 282 is connected to this actuating piece 281.

The solenoid 282 is adapted to move the gate plate 279 by being energized. When the solenoid 282 is turned off, the tip of the gate plate 279 opposes the front end of the placement plate 250 for preventing the take out of the bank note, and at the same time for receiving the stored bank note, while when the solenoid 282 is turned on the tip of the gate plate 279 is moved away from the front end of the placement plate 250 for allowing the take out of the bank note.

In the drawing, 283 is a ninth sensor for detecting the sending in of the bank notes, while 284 is a tenth sensor for detecting the taken out bank notes, and these consist of per se known photoelectric sensors.

When the bank note storage unit 30 stores bank note, the gate plate 278 is opposed to the front end of the placement plate 250, and bank note is not to be taken out. When the motor 277 and the electromagnetic clutch 274 are turned on, the send in roller 254 and the auxiliary roller 257 are rotated in the sending in direction.

The take out roller 266 is also rotated in the taking out direction, but the bank note is not taken out by being prevented by the gate plate 278.

A sixth sorting plate 253 projects into the conveying passage 28 and takes in the bank note which is being conveyed. The bank note receives a conveying force from the send in roller 254, and is given some rigidity by being curved by the curling roller 259, and is stored in the frontmost position of the placement plate 250 under the additional action of the auxiliary roller 257.

When the bank note stored in the bank note storage unit 30 is to be taken out, the sixth solenoid 282 is turned on for releasing the gate plate 279. The bank note is taken out by the take out roller 266 being rotated in the taking out direction with the take out surface 268 contacting the bank note, and the money taken out is sent out into the conveying passage 28 by being guided by the guide plate 272. When a selected number of bank notes has been taken out, the take out roller 266 stops and, with the fifth solenoid 265 turned on and the frame 266 displaced, the pushing plate 263 pushes the frontmost bank note inwardly. The bank note whose tip has been slightly taken out by the take out roller 266 is pulled back by this pushing and when the sixth solenoid 282 is turned off the gate plate 279 is closed. Thereafter the fifth solenoid 265 is turned off, and the pushing plate 263 returns to its original position.

A part of the placement plate 250 of the bank note storage unit 30 for storing bank notes is structured as a cartridge 285 as shown in FIG. 2 and is made detachable.

The structure for pooling and taking out the bank notes at the incoming bank note temporary pooling unit 29 is identical to that of the bank note storage unit 30, but the storing capacity for the bank notes is selected so as to be enough for accommodating the number of bank notes which is allowed for each transaction.

Figure 12:
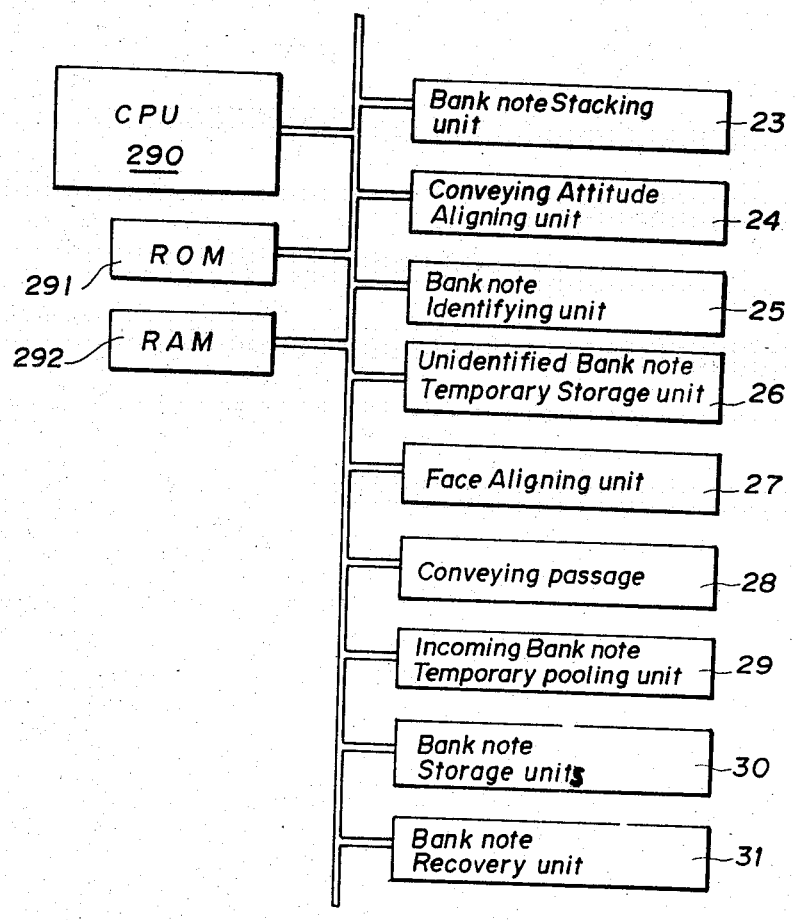
FIG. 12 is a block diagram of the control unit.

FIG. 12 shows a control unit 32, in which a CPU 290 controls each of the units 23 to 31 according to a program stored in a ROM 291, and a RAM 292 performs the writing and the reading of data. Now, the money accepting processing action of the bank note processing device 21 of this structure will be described in the following with reference to the flow chart of FIG. 13.

Figure 14:
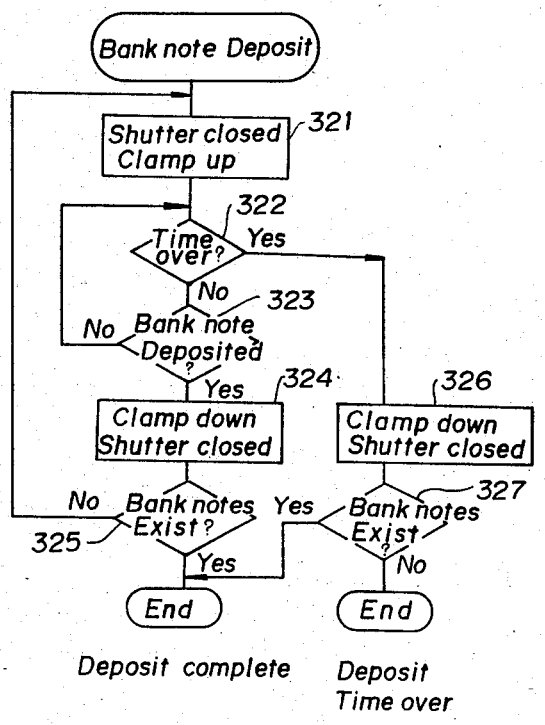
FIG. 14 is a flow chart of the bank note depositing process.

The CPU 290 performs a processing relating to the acceptance of bank notes in step 301. As shown in FIG. 14, this processing is performed based upon money depositing transaction by the user, and in step 321 the bank note stacking unit 23 raises the clamp 38 by driving the motor 64 in the forward direction followed by the actions that a shutter (which is not shown in the drawing) of the money access opening 22 is opened and when the clamp 38 has reached its upper limit the motor 64 is stopped and the clamp 38 stops rising before the stopped positions is locked by a lock piece 59.

When the user deposits incoming bank notes into the clamp 38, it is checked whether it is time over or not in step 322. This overtime checking is made by the counting action of a timer provided in the CPU 290, and the time is set as the required time from opening the shutter to depositing of the money.

If the bank notes are deposited within the time, the sensor 120 of the money access opening 22 detects it in step 323 and in step 324 the locking of the clamp 38 by the lock piece 59 is released, the clamp 38 is lowered by the reverse driving of the motor 64, and the shutter of the money access opening 22 is closed.

When the clamp 38 has reached its lower limit, in step 325 it is checked if there is any incoming bank note by the sensor 121 of the bank note stacking unit 23, and when there is no bank note to come the control flow returns to the step 321, while when there are any bank notes it is determined that the depositing of the bank notes is complete.

If it is determined that the time is over in the step 322, in step 326 the same action as in the step 324 is performed, and the clamp 38 comes down. And in step 327, like in the step 325, it is checked whether there is any bank note, and when there are some bank notes it is determined that the depositing is complete, while when there is no bank note it is determined that the depositing time is over and the process of depositing the bank notes is completed.

Figure 13:
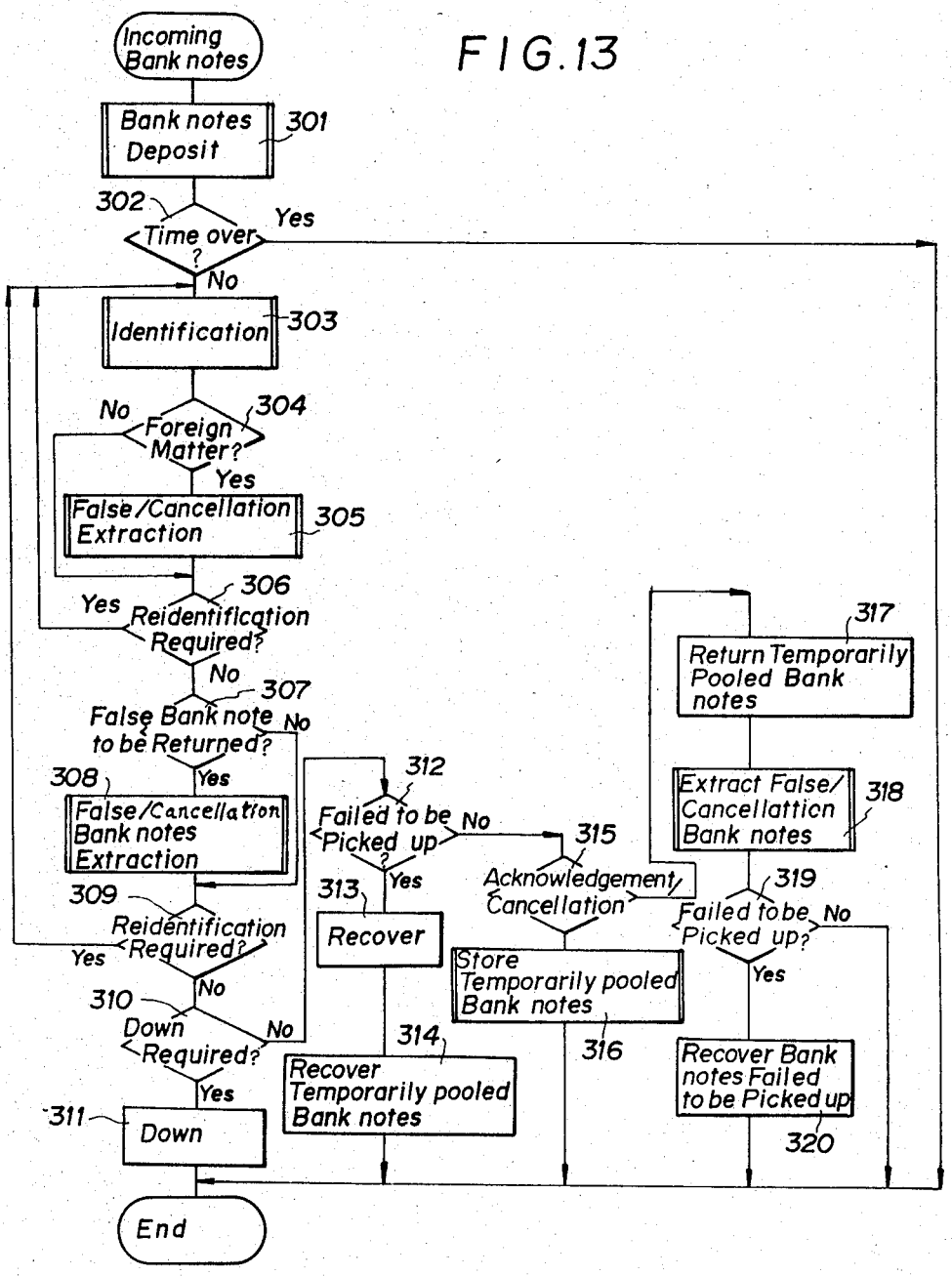
FIG. 13 is a flow chart of the incoming bank note handling process.

In FIG. 13, when the processing relating to the bank note depositing in step 301 is completed, in step 302 it is determined whether the processing of the previous stage was time over, and when it was depositing time over the device 21 ceases its action and the processing action related to money depositing is completed.

Figure 15:
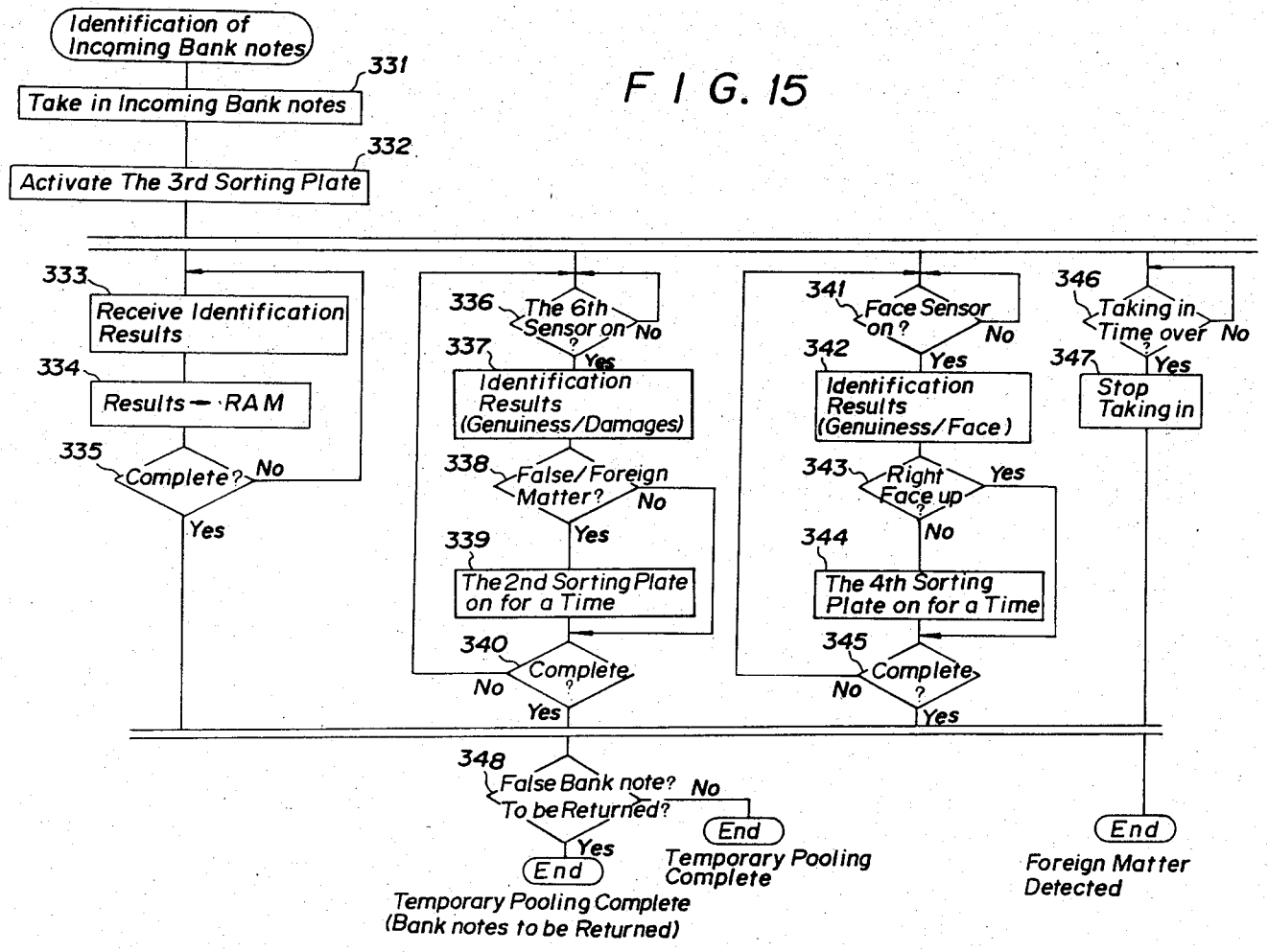
FIG. 15 is a flow chart of the bank note identifying process.

When a normal money depositing action has taken place, in step 303 the processing relating to the identification of the deposited money is performed. This processing is performed as shown in FIG. 15.

Specifically, the conveying belts for the various units 23 to 25, 27 to 31 are driven in the conveying direction for conveying the bank notes to the incoming bank note temporary pooling unit 29, and the first sorting plate 119 is in a position for sorting the bank notes into the conveying attitude aligning unit 25, the second sorting plate 182 is in a position for sorting the bank notes into the face aligning unit 27, the fourth sorting plate 224 of the face aligning unit 27 is in a position for sorting the bank notes into the conveying passage for free passage 225, the fifth sorting plate 246 of the conveying passage 28 is in a position for sorting the bank notes to the upper side, and the sorting plate 253 of the incoming bank note temporary pooling unit 29 is in a sorting position for taking in the bank notes by projecting into the conveying passage 28.

In step 331, the bank note stacking unit 23 opens the receiving plate 49 of the clamp 38 and by moving the pressure plate 77 biases the bank note towards the take in roller 91, and by driving the motor 108 the bank notes are taken inside.

In step 332, the third sorting plate 189 of the unidentified bank note temporary storage unit 26 is set up so as to convey the bank notes to the conveying passage for storage 180.

The bank notes taken in from the bank note stacking unit 23 are conveyed to the conveying attitude aligning unit 24 by the first sorting plate 119 and after being moved sideways to the middle by the sideways motion roller 153 of the aligning unit 24 and the skew of the bank note has been corrected by the aligning stopper 154 the bank notes are sent out to the bank note identifying unit 25.

In the bank note identifying unit 25 the printed pattern of the bank note is read by the image sensor 178 and the photoelectric sensor 179 to determine the validity of the bank note, to determine the denomination, and to determine which face is up, and the following processing is performed in parallel thereafter.

In step 333, the above mentioned identification of the bank note is performed, and in step 334 the results are stored in a prescribed area of the RAM 292. In step 335, it is determined whether the identification of all the incoming bank notes is complete or not, and if not the flow of control returns to step 333.

When it is detected in step 336 that an identified bank note has passed the sixth sensor 208, in step 337 the result of the identification is read out from the RAM 292 and it is determined whether it is a forged bank note or a platstic cart or some other foreign material or not. If so, it is determined that the bank note is unidentified bank note, and in step 339 the second sorting plate 182 is moved for a certain time interval to store this bank note in the conveying passage for storage 180 of the unidentified bank note temporary storage unit 26. And on the other hand when it is determined that it is not invalid bank note in step 338 then since it is a genuine bank note it is conveyed to the face aligning unit 27.

And in step 340 it is checked whether all the incoming bank notes have passed through the process of determining whether it is invalid bank note or not, and if this is not complete the flow of control is returned to step 336.

When it is detected that the bank note has passed the sixth sensor 208 in step 341, the identification result is read out from the RAM 292 in step 342. In step 343 it is determined which face of the bank note is up, and when it is reversed, in step 344 the fourth sorting plate 224 is moved for a certain time interval and conveys the bank note to the inversion frame 232. The inversion frame 232 selects either one of the stoppers 236 and 237 in correspondence with the denomination involved and with the bank note thereby taken out from the vane wheel 231 the bank note is inverted and conveyed to the conveying passage 28. If it is determined that the right side is up in step 343, then it is conveyed to the conveying passage 28, and further in step 345 it is checked whether all the face determination of the incoming bank notes is completed or not, and if it is not complete yet the flow of control returns to step 341.

The bank note which has passed the face aligning unit 27 is conveyed to the incoming bank note temporary pooling unit 29 by way of the conveying passage 28 and is temporarily pooled therein.

And in step 346 the time which has passed since the taking in has occurred is checked. Specifically, when the taking in has started, the CPU 290 starts counting the time, and if the third sensor 122 does not detect the bank note after the passage of a predetermined time then it is determined that a foreign material such as a plastic card or an account book has been taken in, and driving of the take in roller 91 is terminated in step 347 and the taking in processing of the bank note is completed as a case of detecting a foreign material.

After the completion of the above phases of parallel processing, in step 348 it is determined whether there is any bank note to be returned, according to the existence of the stored bank note, and when there is any bank note to be returned then the processing is completed as a case of the completion of the temporary pooling of the bank note to be returned and otherwise the processing is completed as a case of the completion of the temporary pooling of the bank note without returning any bank note.

And the result of this taking in processing is stored in a prescribed area of the RAM 292.

With reference to FIG. 13, in step 304 it is determined whether the processing is completed by detecting a foreign material in the previous step 303 from the stored information in the RAM 292 and when it is detected the flow of control moves to step 305, otherwise the step 305 is skipped.

Figure 16:
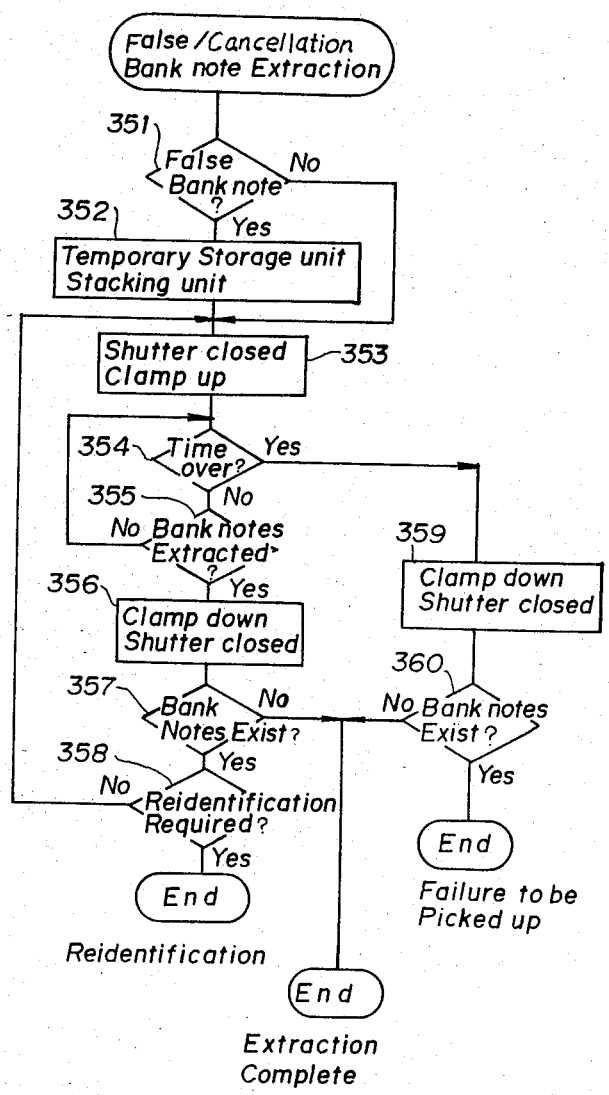
FIG. 16 is a flow chart of the invalid/cancelled bank note extraction process.

The step 305 is a false/canceled bank note extraction processing shown in FIG. 16. In step 351 it is determined whether it is an unidentifed bank note or not, and if it is determined that it is an unidentified bank note then in step 352 the unidentified bank note temporary storage unit 26 sends out the bank note stored in the conveying passage for storage 180. At this time, the first sorting plate 119 is switched to a position for guiding the bank note to the bank note stacking unit 23, and the stored bank note is accumulated in the bank note stacking unit 23.

In step 353, the clamp 38 raises the bank note to be returned to the side of the money access opening 22 by gripping it, and the shutter of the money access opening 22 is opened for returning the money to the user.

In step 354, the CPU 290 counts the time required from opening the shutter to extracting the bank note to be returned and determines whether it is time over and further determines whether the bank note to be returned is extracted or not in step 355.

When in step 355 the extraction of the bank note is ascertained according to the output from the sensor 122, and in step 356 the bank note stacking unit 23 lowers the clamp 38 and the shutter of the money access opening 22 is closed. When in step 357 it is determined whether the bank note exists or not according to the output from the sensor 121 of the bank note stacking unit 23, and it is determined that the bank note does not exist, then the processing is completed as a case of the completion of the extraction. When it is determined that the bank note exists, then it is determined in step 358 whether the reidentification is to be performed or not, and this determination is performed according to the data relating to the failure of identification stored in the RAM 292. When it is determined that a reidentification is to be performed, the processing is completed as the case of reidentification; and when it is determined otherwise it is determined as a case of the failure to pick up the bank note and the flow of control returns to the step 353.

When the time over is determined in step 354, in step 359 the bank note stacking unit 23 lowers the clamp 38 and the shutter of the money access opening 22 is closed, in step 360 it is determined whether the bank note is in existence in the bank note stacking unit 23 and if it is determined so then the processing is completed as a case of the failure to pick up the bank note to be returned and if it is determined otherwise then the processing is completed as a case of the completion of the extraction.

The processing result of the bank note extraction processing is stored in a prescribed area of the RAM 292.

With reference to FIG. 13, it is determined in step 306 whether a reidentification is required in the processing of the steps 303 and 305 and if it is so determined then the flow of control returns to the step 303. When it is determined that no reidentification is required, then it is determined whether there is any bank note to be returned, in step 307, and when it is so determined then the flow of control moves to step 308 and if otherwise the step 308 is skipped.

The determinations described above are performed according to the processing results stored in the RAM 292.

The step 308 is a false/canceled bank note extraction processing and the processing described with reference to FIG. 16 is performed.

Further, in step 309, it is again determined whether reidentification is required, and if it is so determined then the flow of control returns to step 303. If otherwise, in step 310 it is determined whether the bank note processing device 21 should be inactivated, and if a completion is determined to be required due to the existence of a foreign material according to the stored information about the processing result in the RAM 292, then in step 311 the device 21 is inactivated and the processing actions are completed.

When completion of the processing for failure to pick up the bank note to be returned is determined in step 312, the bank note to be returned stored in the bank note stacking unit 23 is recovered to the bank note recovering unit 31 in the step 313.

Specifically, the bank note to be returned is supplied from the bank note stacking unit 23 to the conveying passage 28 by way of the conveying attitude aligning unit 24, the bank note identifying unit 25, and the face aligning unit 27, and, as the fifth sorting plate 246 opens the conveying passage on the side of the bank note recovering unit 31, the bank note to be returned is recovered by the bank note recovering unit 31.

In step 314, the incoming bank note which is pooled in the incoming bank note temporary pooling unit 29 is also recovered in the bank note recovering unit 31. Specifically, the temporary pooling unit 29 sends out the bank note pooled therein to the conveying passage 28 by rotating the take out roller 266 and the bank note, after being supplied to the conveying attitude aligning unit 24 from an end of this conveying passage 28, is recovered by the bank note recovering unit 31, in the same way as in the previously described recovering action, before the device 21 is inactivated for the completion of the processing actions.

When it is determined that there was no failure to pick up the bank note in the step 312, it means that the money depositing process is in normal progress, and by asking to the user whether the required service is the acknowledgement of the money deposit or the cancellation of the transaction, the user can perform either an acknowledgement or cancellation action.

When the acknowledgement of the money deposit is determined in the step 315, in this step 316 the bank note which was temporarily pooled is identified and then stored.

Figure 17:
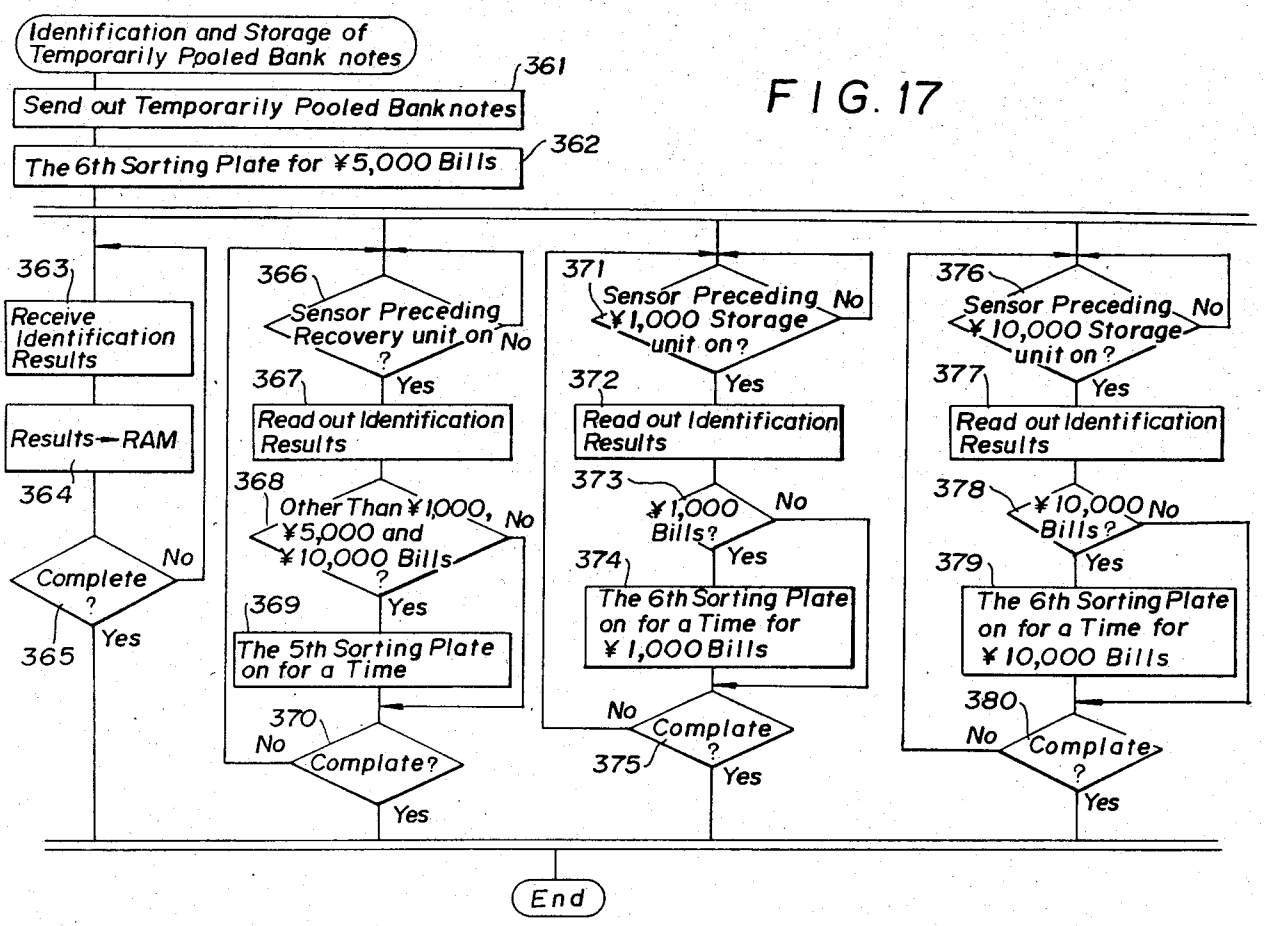
FIG. 17 is a flow chart of the temporary pooled bank note identification/storage process.

This processing is the temporarily pooled bank note identifying and storing process shown in FIG. 17, and this process takes out the bank note pooled in the incoming bank note temporary pooling unit 29 and then determines the denomination and any damaged bank note in the bank note identifying unit 25. Here the damaged bank note determination is a determination for any bank note which is not appropriate as the outgoing bank note because although it is genuine it is too much damaged. Then according to the results of these determinations the bank note is stored in the bank note storage unit 30 and the bank note recovery unit 31.

The bank note storage units 30 correspond to different denominations of bank notes and the uppermost stage is allocated for $\overset{\vee}{\geqq}$ 5,000 bills, the next stage for $\overset{\vee}{\geqq}$ 10,000 bills, and the third stage for $\overset{\vee}{\geqq}$ 1,000 bills.

In step 361, the temporary pooling unit 29 takes out the bank note and in step 362 the sixth sorting plate 253 of the bank note storage unit 30 of the uppermost stage for $\overset{\vee}{\geqq}$ 5,000 bills is projected into the conveying passage 28 for storing the conveyed bank note therein.

In the step 361, the bank note taken out from the temporary pooling unit 29 is supplied to the conveying attitude aligning unit 24 for alignment and after being identified in the bank note identifying unit 25 is conveyed to the conveying passage 28 by way of the face aligning unit 27.

In step 363, the CPU 290 determines the result of identification and stores the result in the RAM 292. In the step 365 it is checked whether the identification of all the bank notes is complete or not, and if not then the flow of control returns to the step 363.

When the fact that the bank note is conveyed to a stage preceding the bank note recovery unit 31 is detected by an appropriate sensor in the step 366, in step 367 the identification results in the RAM 292 are read out and it is determined if it is a damaged bank note or not, in the step 368. If so, then the fifth sorting plate 246 is moved for a certain time interval in the step 369, and the damaged bank note is recovered to the bank note recovery unit 31. In step 370, it is checked whether the processing of all the bank notes is completed or not, and if not the flow of control returns to the step 366.

The steps 371 to 375 are storing processes for $\overset{\vee}{\geqq}$ 1,000 bills, the steps 376 to 380 are storing processes for 10,000 bills, and the bank note of different denominations is stored in the storage units 30 of the corresponding denominations by performing the processing actions for each of the denominations in the same way as in the previously described steps 366 to 370. And the bank note which has passed through the checking for denomination and any damage is determined as an $\overset{\vee}{\geqq}$ 5,000 bill and is stored in the bank note storage unit 30 of the uppermost stage.

When the above described parallel processes are completed, then this temporarily pooled bank note identifying and storing process is completed.

With reference to FIG. 13, the cancellation of the transaction is determined in the step 315, and in the step 317 the bank note pooled in the incoming bank note temporary pooling unit 29 is returned to the bank note stacking unit 23.

Specifically, the bank note taken out from the temporary pooling unit 29 is supplied to the conveying attitude aligning unit 27, and then to the unidentified bank note temporary storing unit 26 by way of the bank note identifying unit 25.

In this unidentified bank note temporary storing unit 26, the conveying passage for free passage 181 is opened and the bank note is accumulated in the bank note stacking unit 23 by way of this conveying passage for free passage 181.

In the step 318, the false/cancelation bank note extraction process which was described with reference to FIG. 16 is performed, and bank note is released to the money access opening 22 so that the user can pick it up.

In the step 319, it is checked whether the bank note is failed to be picked up or not, and if so then in step 320 this bank note is recovered to the bank note recovery unit 31 before completing this money depositing process.

Next, the money dispensing process will be described with reference to the flow chart of FIG. 18.

The outgoing bank note is set for ¥ 1,000 and ¥ 10,000 bills, and the money to be dispensed according to the request from the user is stored in the RAM 292, and the take out processing of the bank notes is performed in step 381.

Figure 19:
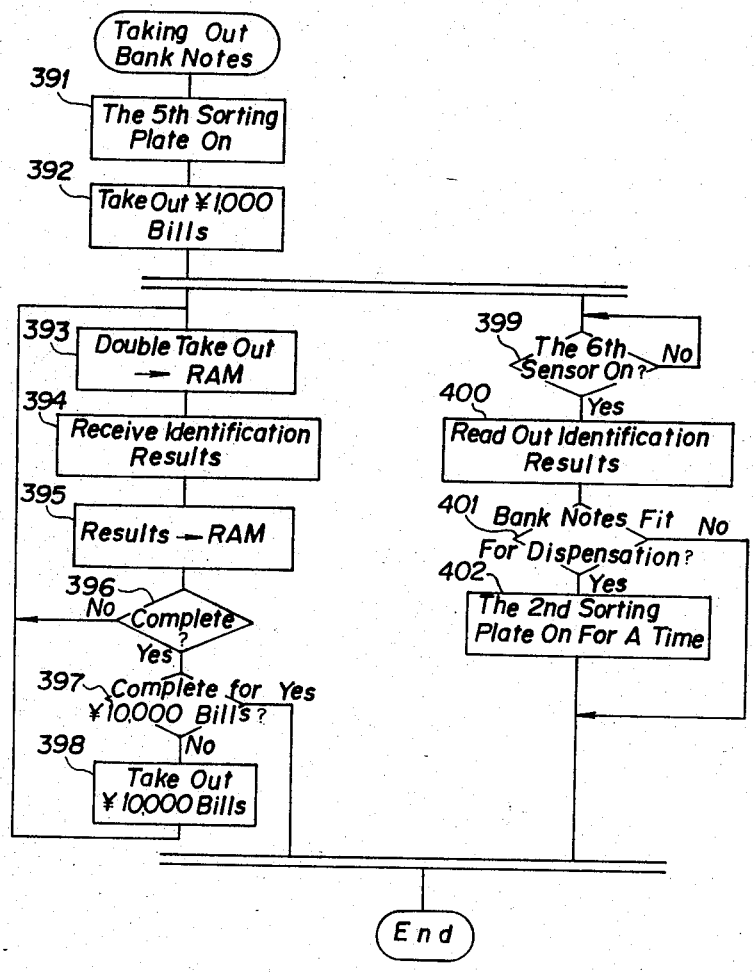
FIG. 19 is a flow chart of the bank note dispensing process.

The process of the step 381 is the bank note taking out process shown in FIG. 19. In the step 319, the fifth sorting plate 246 opens the conveying passage to the side of recovery and prepares for recovery of unacceptable bank note. Then the bank note is taken out by driving the bank note storage unit 30 of the lowermost stage which stored ¥ 1,000 bills in the step 392 and the following parallel processes are performed.

In the step 393, the bank note take out conditions are read out according to the output from the tenth sensor 284, and if there was any double take out then the result is stored in the RAM 292.

The bank notes taken out from the bank note storage units 30 are aligned in the conveying attitude aligning unit 24 and its denominations are determined by the bank note identifying unit 25. In the step 394 the identification result is received, in step 395 the result is stored in the RAM 292, in step 396 it is determined whether the taking out is complete or not, if not the flow of control returns to the step 393, and if the taking out of ¥ 1,000 bills is complete then in step 397 it is determined whether the taking out of ¥ 10,000 bills is complete or not, and if not then in step 398 the taking out of the ¥ 10,000 bills is performed through the bank note storage unit 30 of this particular denomination. And the completion of the taking out of the bank note of each denomination is determined by the comparison of the requested amount of the money to be dispensed stored in the RAM 292 with the value of the actually taken out bank notes.

When the bank note which has passed through the identification is detected by the sixth sensor 208 in the step 399, in step 400 the identification result is read out from the RAM 292, in step 401 it is determined whether it is good for dispensing or not, and if not then in step 402 the second sorting plate 182 is moved for recovering it to the bank note recovery unit 31.

Meanwhile, the bank note good for dispensing is accumulated in the bank note stacking unit 23 by way of the conveying passage for free passage 181 of the unidentified bank note temporary storage unit 26.

Figure 18:
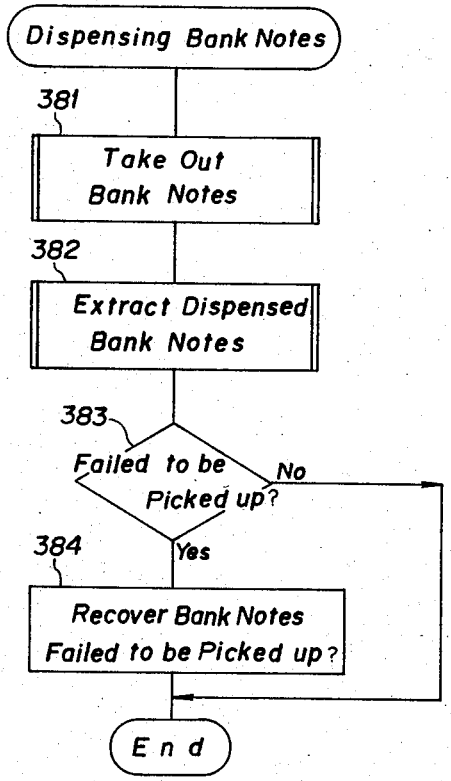
FIG. 18 is a flow chart of the outgoing bank note handling process.

With reference to FIG. 18, when the process of step 381 is completed, then the outgoing bank note extraction process is performed in step 382.

Figure 20:
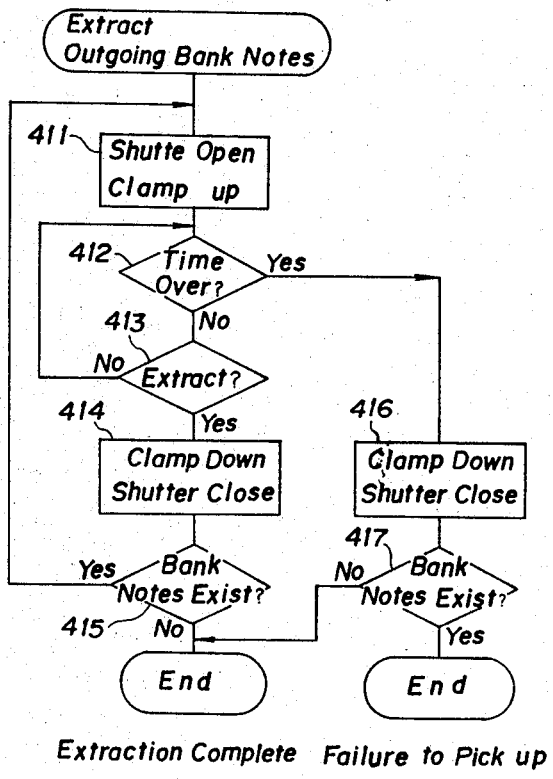
FIG. 20 is a flow chart of the outgoing bank note extraction process.

The process of the step 382 is the process shown FIG. 20. Specifically, in step 411 the bank note stacking unit 23 raises the outgoing bank note accumulated therein by gripping it with the clamp 38, opens the shutter of the money access opening 22, and releases the bank note to the money access opening 22.

Then, the CPU 290 counts the time required from the opening of the shutter to the extraction of the bank note, determines whether the time is over in the step 412, and determines whether it has been extracted or not according to the output from the sensor 120 in the step 413.

When the extraction is determined, in the step 414 the clamp 38 is lowered, the shutter of the money access opening is closed, in step 415 the existence of the bank note is determined according to the output from the sensor 121, and if the bank note is in existence then the flow of control returns to the step 411 and otherwise it is determined that the extraction is complete.

When the time over is determined in the step 412, in step 416 the clamp 38 is lowered, the shutter of the money access opening 22 is closed, and in step 417 the existence of the bank note is determined. If so, then the process is completed as a case of failure to pick up the bank note and otherwise it is determined as the case of the completion of the extraction.

With reference to FIG. 18, when the process of the step 382 is completed, in step 383 it is checked whether there is any failure to pick up the bank note and if so this bank note failed to be picked up is recovered to the bank note recovery unit 31 in step 384. And if there is no failure to pick up the bank note, it means that the outgoing bank note has been properly dispensed to the user and the money dispensing process is completed.

Although the present invention has been shown and described with reference to the preferred embodiments thereof, and in terms of the illustrative drawings, it should not be considered as limited thereby. Various possible modifications, omissions, and alterations could be conceived of by one skilled in the art to the form and the content of any particular embodiment, without departing from the scope of the present invention. Therefore it is desired that the scope of the present invention, and of the protection sought to be granted by Letters Patent, should be defined not by any of the perhaps purely fortuitous details of the shown preferred embodiments, or of the drawings, but solely by the scope of the appended claims, which follow.

What is claimed is:

1. A bank note processing device, comprising:

a money access opening in the upper part of the bank note processing device for accepting incoming bank notes and releasing outgoing bank notes;

a bank note stacking unit below the money access opening for stacking up the incoming bank notes supplied from the money access opening, sending them out from an internal lower part of a stack of bank notes, stacking up the outgoing bank notes which are sent from an internal upper part of the stack, and supplying the outgoing bank notes to the money access opening;

a conveying attitude aligning unit, connected to to the bank note stacking unit by a bank note conveying means, for conveying the bank notes sent out from the lower part of the bank note stacking unit to a sending out position located thereabove, and aligning the conveying attitude of the bank note which is sorted in the sending in position and conveyed therefrom;

a bank note identifying unit below this conveying attitude aligning unit for identifying the genuineness and the denomination of the bank note conveyed from the conveying attitude aligning unit;

an unidentified bank note temporary storage unit in front of the bank note identifying unit and below the bank note stacking unit for sorting the bank note conveyed from the bank note identifying unit, temporarily storing this bank note, letting the bank note which does not require storage freely through this unit and conveying the bank note to be stored and freely passed bank note to a sending out side of the lower part of the bank note stacking unit;

a face aligning unit below the unidentified bank note temporary storage unit and the bank note identifying unit for sorting the bank note conveyed from the bank note identifying unit so that all the bank notes face the same side up;

a conveying passage, to the rear of the conveying attitude aligning unit and the face aligning unit, which can convey the bank notes from the face aligning unit to the conveying attitude aligning unit; and, along this conveying passage, an incoming bank note temporary pooling unit which takes in the incoming bank notes from this conveying passage for temporarily pooling and sending out the pooled bank notes to the conveying passage, a plurality of bank note storage units each of which takes in and stores the incoming bank notes of a corresponding denomination from the conveying passage and is associated with the denomination of the outgoing bank notes which are to be sent out to the conveying passage for dispensation, and a bank note recovery unit for taking in the bank notes to be recovered from the conveying passage, in that order from above to below.

2. A bank note processing device according to claim 1, wherein the money access opening and the bank note stacking unit are located directly above the bank note storage units.

3. A bank note processing device according to claim 1, wherein the money access opening and the bank note stacking unit are located directly above the unidentified bank note storage unit.

4. A bank note processing device according to claim 1, wherein the money access opening and the bank note stacking unit may be located either directly above the bank note storage units or directly above the unidentified bank note storage unit.

* * * * *